US011058940B2

(12) United States Patent
Gilday et al.

(10) Patent No.: US 11,058,940 B2
(45) Date of Patent: Jul. 13, 2021

(54) SPORTS GLOVE

(71) Applicant: WILSON SPORTING GOODS CO., Chicago, IL (US)

(72) Inventors: Shaun P. Gilday, Chicago, IL (US); Allen G. Wagner, Beavercreek, OH (US); Bradley L. Gaff, Chesterton, IN (US); Rey C. Corpuz, Hinsdale, IL (US)

(73) Assignee: Wilson Sporting Goods Co., Chicago, IL (US)

( * ) Notice: Subject to any disclaimer, the term of this patent is extended or adjusted under 35 U.S.C. 154(b) by 281 days.

(21) Appl. No.: 15/914,298

(22) Filed: Mar. 7, 2018

(65) Prior Publication Data

US 2018/0193718 A1 Jul. 12, 2018

Related U.S. Application Data

(63) Continuation of application No. 14/452,260, filed on Aug. 5, 2014, now abandoned.

(60) Provisional application No. 61/862,780, filed on Aug. 6, 2013.

(51) Int. Cl.
*A63B 71/14* (2006.01)
*A41D 19/015* (2006.01)

(52) U.S. Cl.
CPC ..... *A63B 71/148* (2013.01); *A41D 19/01564* (2013.01); *A41D 19/01523* (2013.01); *A41D 2600/10* (2013.01); *A63B 71/141* (2013.01); *A63B 2209/00* (2013.01); *A63B 2243/007* (2013.01)

(58) Field of Classification Search
CPC ..... A41D 19/01564; A41D 19/01558; A41D 19/01523
USPC ..... 2/159, 161.1
See application file for complete search history.

(56) References Cited

U.S. PATENT DOCUMENTS

| | | | |
|---|---|---|---|
| 2,309,476 | A | 1/1943 | Patterson |
| 3,164,841 | A | 1/1965 | Burtoff |
| 3,890,649 | A | 6/1975 | Diggins |
| 4,051,553 | A | 10/1977 | Howard |
| 4,295,229 | A | 10/1981 | Clark et al. |
| 4,400,829 | A | 8/1983 | Willis |
| 4,559,646 | A | 12/1985 | Ertl |
| 4,598,429 | A | 6/1986 | Mulvaney |
| 4,689,832 | A | 9/1987 | Mulvaney |
| 4,701,963 | A | 10/1987 | Overton |
| 4,843,651 | A | 7/1989 | Gramza et al. |

(Continued)

*Primary Examiner* — Timothy K Trieu
(74) *Attorney, Agent, or Firm* — Terence P. O'Brien; Todd A. Rathe

(57) ABSTRACT

A sports glove includes a wrist portion defining an opening, a palm portion having a palm side and a backside, a thumb stall and a plurality of finger stalls extending from the palm portion. The palm side comprises a fabric layer bordering an interior of the glove, and a resilient polymer layer on an outer surface of the fabric layer. At least first and second grooves are formed into the polymer layer. The finger stalls include an index finger stall, a middle stall, a ring finger stall and a pinky stall. The first groove forms a thumb base bending line extending from at or adjacent to the opening along the palm portion to a juncture of the thumb stall and the index finger stall. The second groove forms an upper mid-palm bending line extending across the palm portion adjacent at least the pinky finger stall and the ring finger stall.

20 Claims, 11 Drawing Sheets

(56) References Cited

U.S. PATENT DOCUMENTS 4,864,660 A 9/1989 Sawyer
5,117,509 A 6/1992 Bowers
5,183,263 A 2/1993 Kuebler
5,211,248 A 5/1993 Nosewicz et al.
5,316,294 A 5/1994 Turangan
5,335,916 A 8/1994 Nee
5,598,582 A * 2/1997 Andrews ..... A41D 19/01505 2/16
5,608,912 A 3/1997 Cumberland
5,636,381 A 6/1997 Brogden
5,640,712 A 6/1997 Hansen et al.
5,692,242 A 12/1997 Tekerman et al.
5,708,979 A 1/1998 Redwood et al.
5,727,257 A 3/1998 Chen
5,745,919 A 5/1998 Kraatz
5,802,614 A 9/1998 Melone
5,806,091 A 9/1998 McHugh
5,867,830 A 2/1999 Chen
6,006,358 A 12/1999 Keating
6,041,438 A * 3/2000 Kirkwood ..... A41D 19/0034 2/161.1
6,044,494 A 4/2000 Kang
6,049,910 A 4/2000 McCarter
6,052,827 A 4/2000 Widdemer
6,065,155 A 5/2000 Sandusky
6,182,293 B1 2/2001 Mustin
6,185,747 B1 * 2/2001 Hughes ..... A41D 19/01505 2/161.6
6,223,353 B1 5/2001 Lardieri
6,408,442 B1 6/2002 Kang
6,457,181 B1 10/2002 Grundy
6,526,593 B2 3/2003 Sajovic
6,539,550 B1 4/2003 Flores
6,745,402 B2 6/2004 Sajovic
6,745,403 B2 6/2004 Caswell
6,912,731 B2 7/2005 Cass
6,964,063 B2 11/2005 Bamber
7,210,172 B2 5/2007 Adams
7,293,296 B1 11/2007 Beraznik et al.
7,487,553 B2 * 2/2009 Price ..... A41D 19/01547 2/161.1
7,769,251 B2 3/2010 Hammons et al.
7,966,670 B2 6/2011 Wilbert et al.
8,191,174 B2 6/2012 Winningham et al.
8,225,426 B2 7/2012 Bevier
8,225,427 B2 7/2012 Bevier
8,239,969 B2 8/2012 Fisher
8,241,705 B2 8/2012 Sha
8,256,028 B1 * 9/2012 Ibon ..... A63B 71/143 2/161.1
8,266,719 B2 9/2012 Duby
9,198,474 B1 12/2015 Hacobian
10,111,476 B2 * 10/2018 Tamaribuchi .... A41D 19/01547
10,143,248 B2 * 12/2018 Hull ..... A41D 19/01517
2003/0037364 A1 * 2/2003 Albert ..... A63B 71/148 2/161.1
2004/0025226 A1 2/2004 Jaeger
2004/0045074 A1 3/2004 Tremblay
2004/0060097 A1 4/2004 Bamber
2004/0068777 A1 4/2004 Wheelington
2004/0107476 A1 6/2004 Goldwitz
2005/0034213 A1 2/2005 Bamber
2007/0209097 A1 9/2007 Iacullo
2008/0078011 A1 4/2008 Kleinert
2008/0229477 A1 9/2008 McGough
2008/0263747 A1 * 10/2008 DeBlasis ..... A63B 71/141 2/161.1
2008/0271224 A1 11/2008 Wilbert et al.
2009/0077706 A1 3/2009 Prather
2009/0139007 A1 6/2009 Bevier
2009/0139010 A1 * 6/2009 Bevier ..... A63B 71/148 2/161.8
2010/0024095 A1 2/2010 Gellis
2010/0077256 A1 4/2010 Smeltzer
2010/0077532 A1 4/2010 Kettani
2010/0077533 A1 4/2010 Munda
2010/0095428 A1 4/2010 Fisher
2010/0186140 A1 7/2010 Ramirez
2010/0325777 A1 12/2010 Radhakrishnan et al.
2011/0041235 A1 2/2011 Harris
2011/0113521 A1 5/2011 Bradford
2011/0214220 A1 9/2011 Parker
2011/0214221 A1 9/2011 Munda
2011/0258754 A1 10/2011 DuPont
2011/0296582 A1 12/2011 Bevier et al.
2012/0005805 A1 1/2012 Bevier et al.
2012/0011633 A1 1/2012 Van Hale
2012/0028738 A1 2/2012 Love
2012/0030855 A1 2/2012 Clark
2012/0030856 A1 2/2012 Bevier
2012/0042438 A1 2/2012 Ramirez
2012/0073029 A1 3/2012 Clark
2012/0159681 A1 6/2012 Gibby
2012/0204319 A1 8/2012 Gambordella
2012/0227155 A1 9/2012 Brown
2012/0227158 A1 9/2012 Ashworth et al.
2012/0324623 A1 12/2012 Cabauy et al.
2013/0061369 A1 3/2013 Lim
2013/0239291 A1 9/2013 Harris

* cited by examiner

FIG. 1
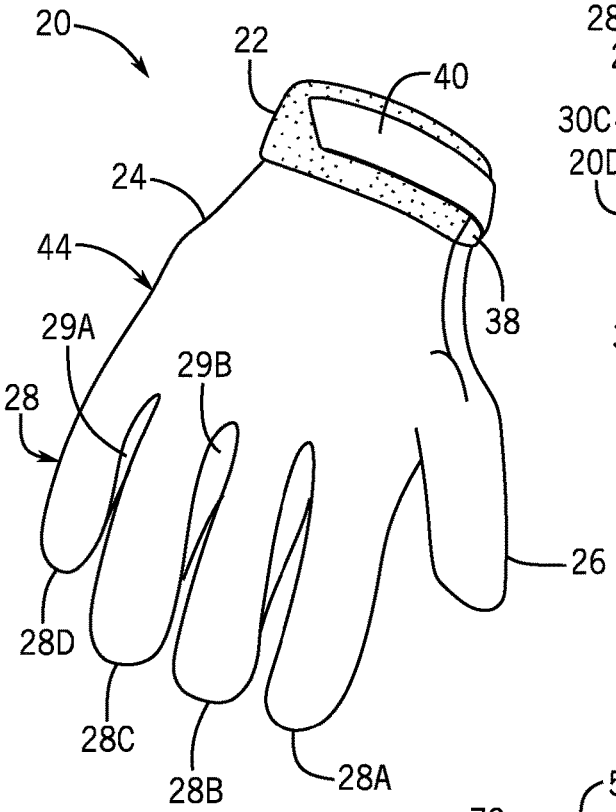
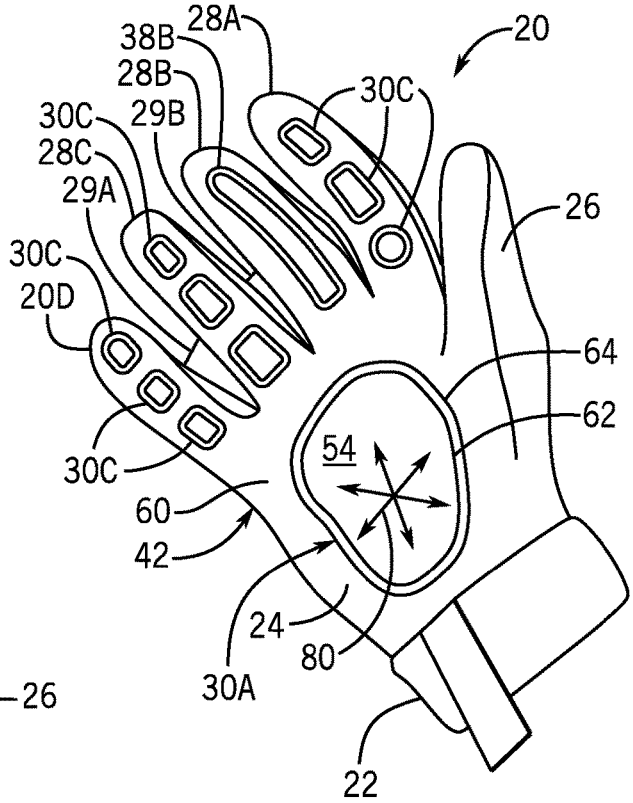
FIG. 2
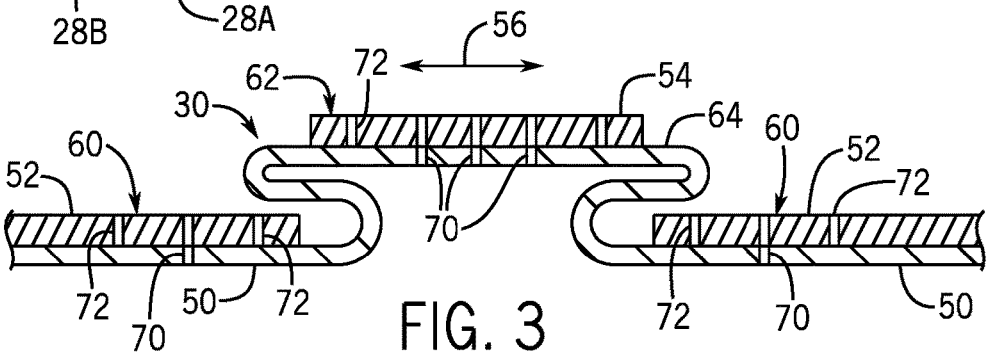
FIG. 3
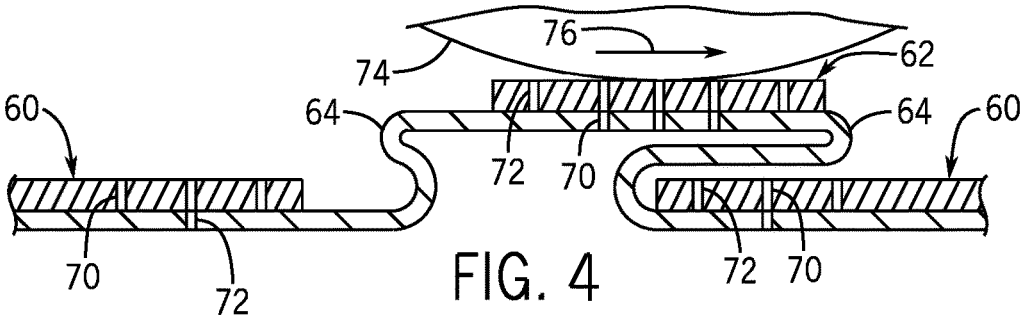
FIG. 4

FIG. 13
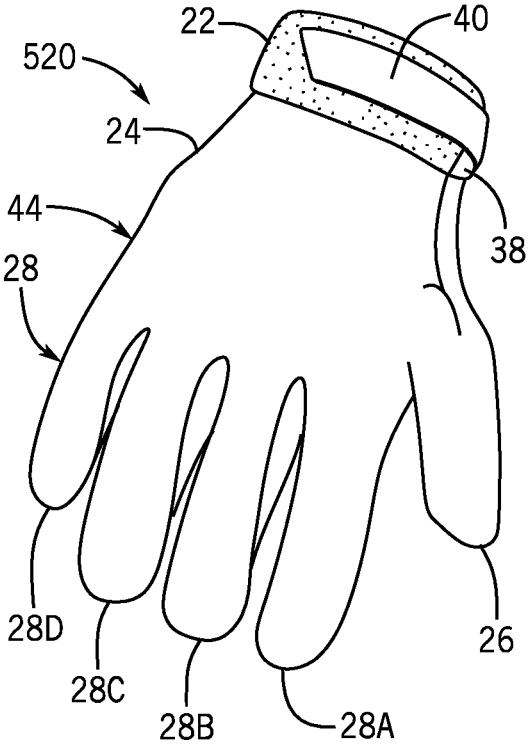
FIG. 14
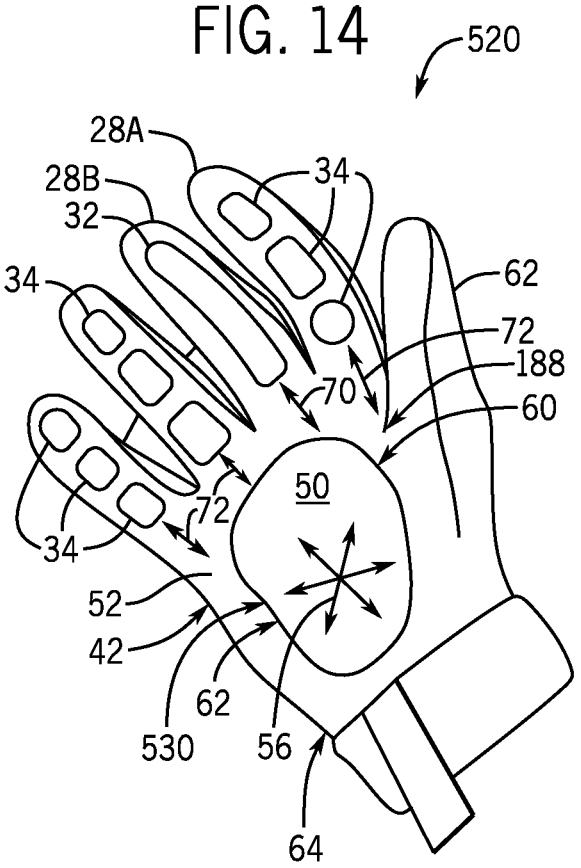
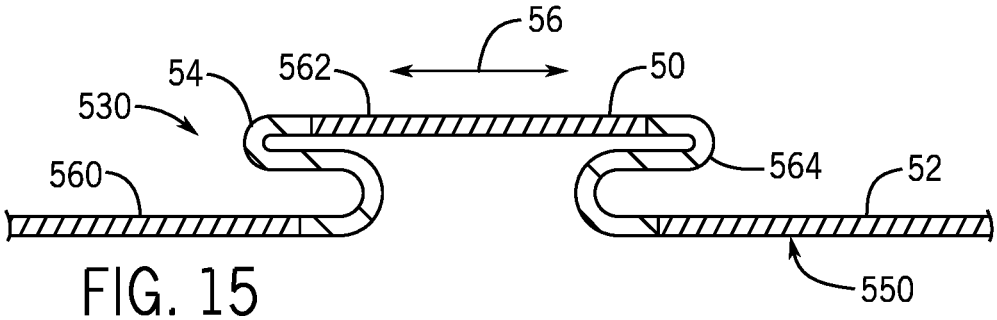
FIG. 15
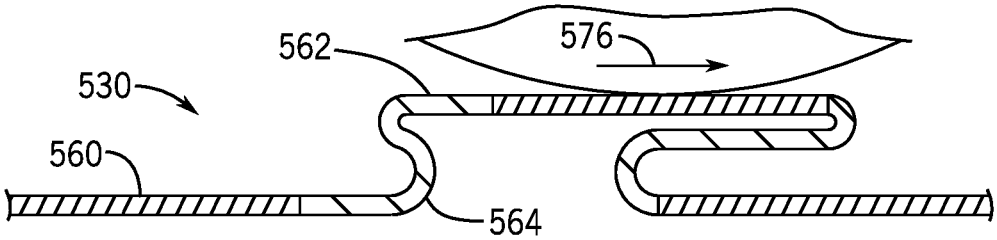
FIG. 16

FIG. 17
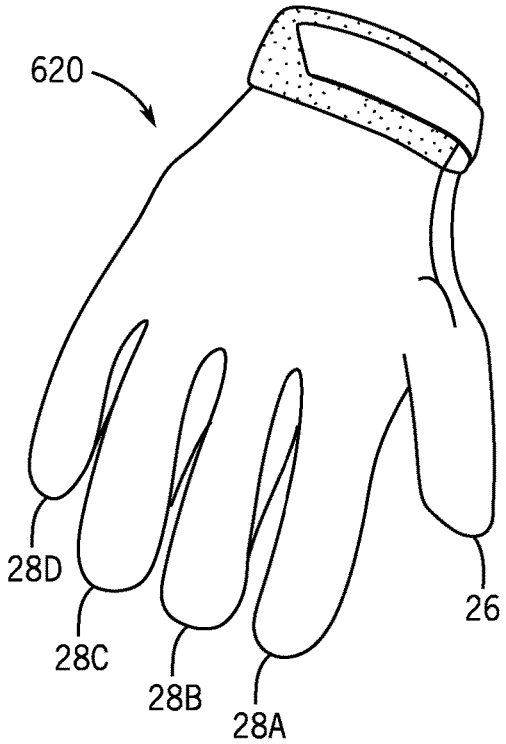
FIG. 18
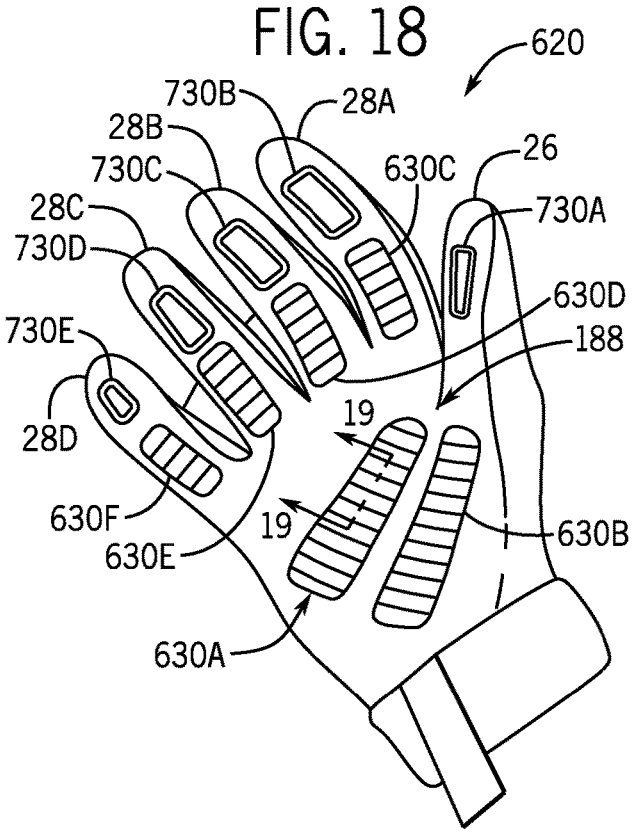
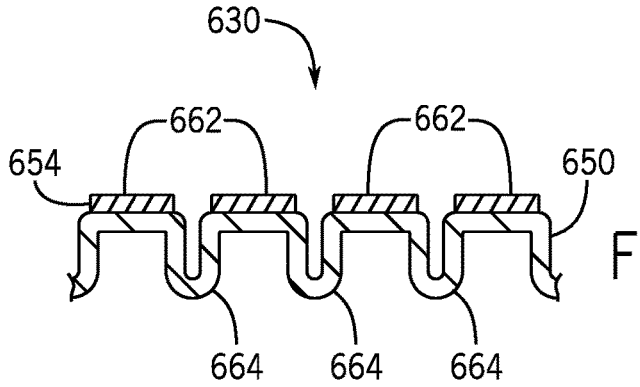
FIG. 19
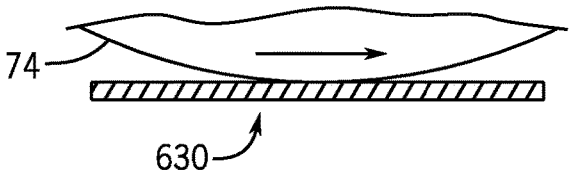
FIG. 20

FIG. 21
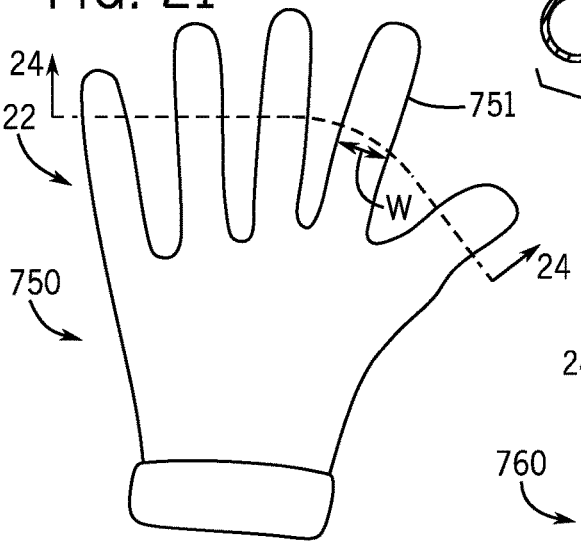
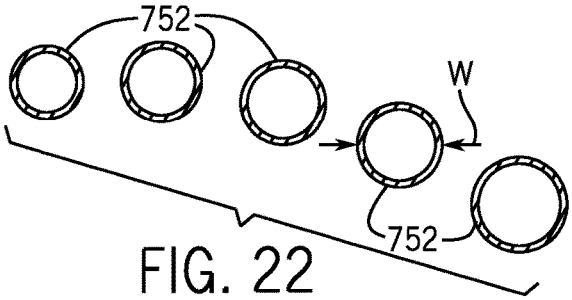
FIG. 22
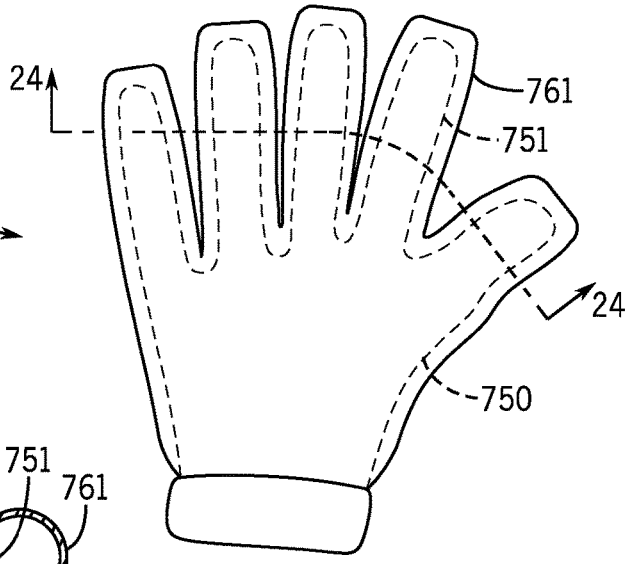
FIG. 23
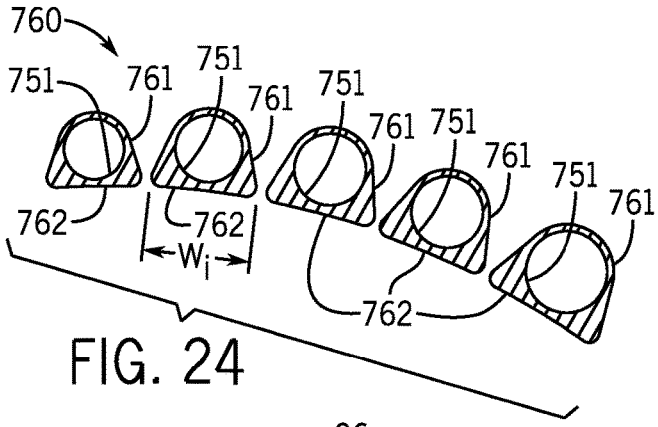
FIG. 24
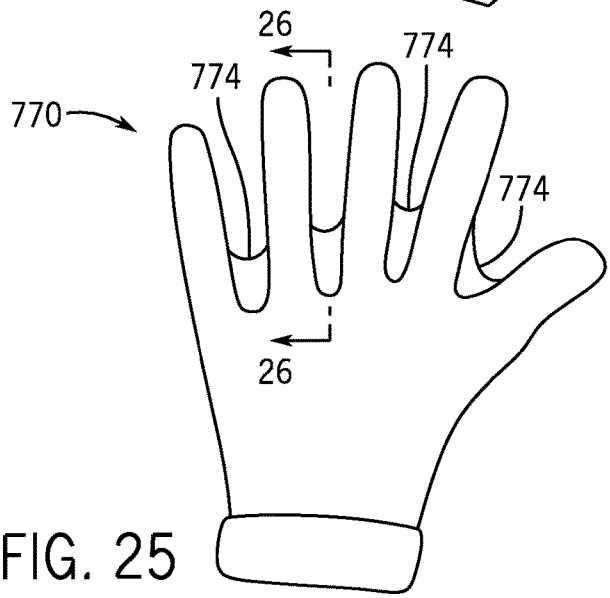
FIG. 25
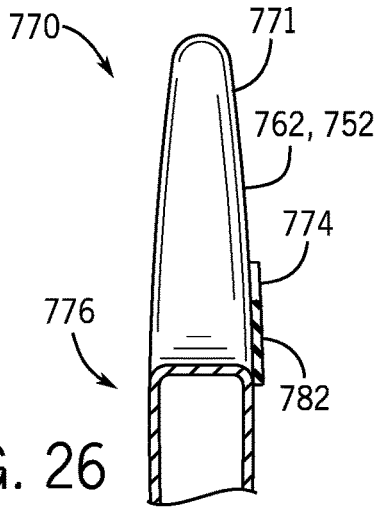
FIG. 26

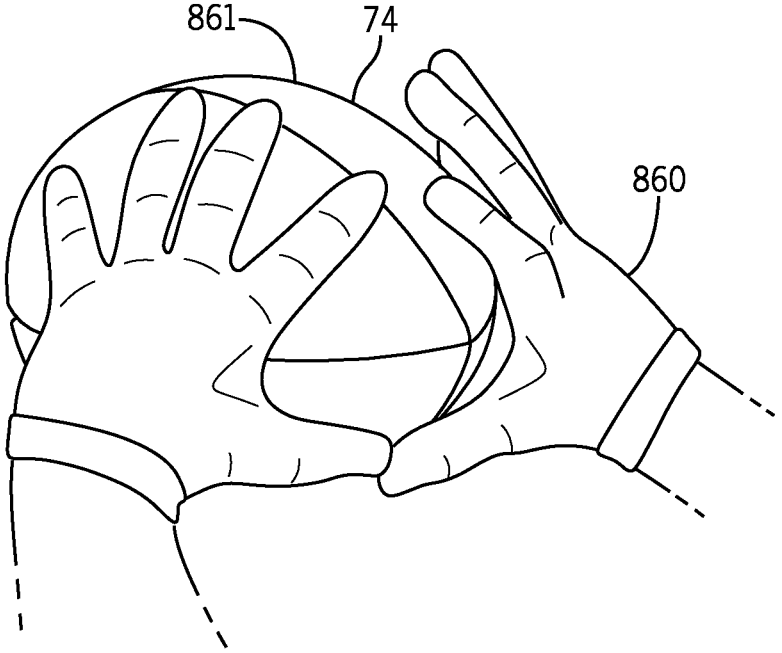
FIG. 34
FIG. 35
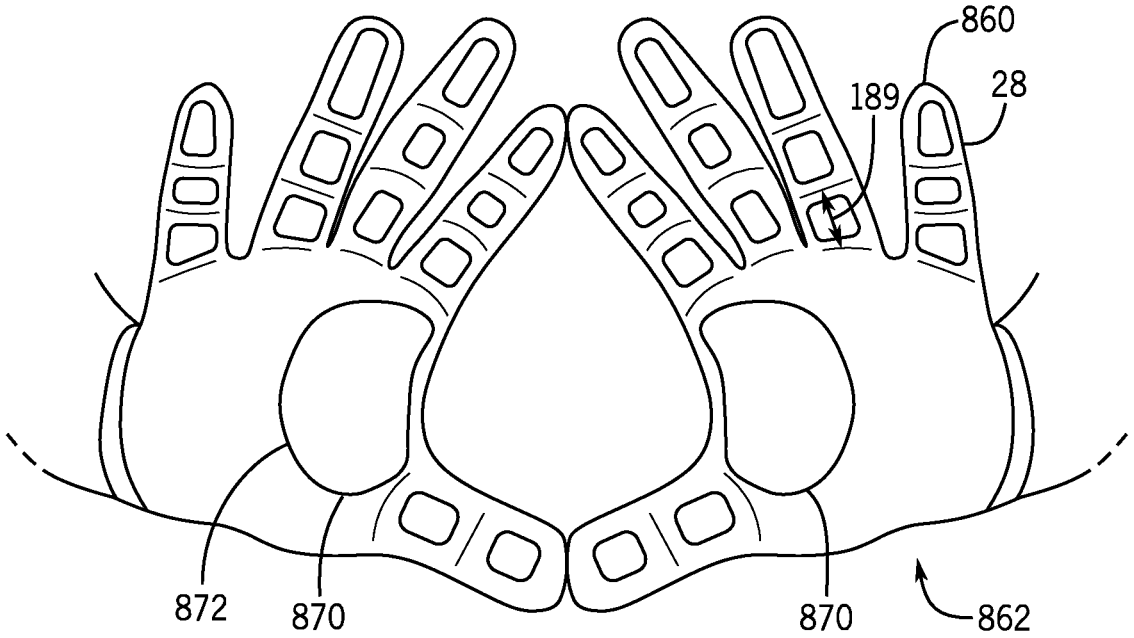

1010

SPORTS GLOVE

RELATED U.S. APPLICATION DATA

The present application is a continuation of U.S. patent application Ser. No. 14/452,260 filed on Aug. 5, 2014. U.S. patent application Ser. No. 14/452,260 claims priority to U.S. Provisional Patent Application Ser. No. 61/862,780 filed on Aug. 6, 2013, which is hereby incorporated by reference in their entirety.

BACKGROUND

The present invention relates generally to gloves employed in sports to protect a participant's hands and to enhance performance.

BRIEF DESCRIPTION OF THE DRAWINGS

FIG. 1 is a rear perspective view of an example glove.

FIG. 2 is a front perspective, palm side view of the glove of FIG. 1.

FIG. 3 is a sectional view of one a movable gripping region of the glove FIG. 2 in an at rest state.

FIG. 4 is a sectional view of the movable gripping region in a stretched state of being contacted by a ball.

FIG. 13 is a rear perspective view of another implementation of the glove of FIG. 1.

FIG. 14 is a front perspective, palm side view of the glove of FIG. 13.

FIG. 15 is a sectional view of an example movable gripping region of the glove of FIG. 14 in an at rest state.

FIG. 16 is a sectional view of the movable gripping region of the glove of FIG. 14 in a stretched state while in engagement with a ball.

FIG. 17 is a rear perspective view of another implementation of the glove of FIG. 1.

FIG. 18 is a front perspective, palm side view of the glove of FIG. 17.

FIG. 19 is a sectional view of an example movable gripping region of the glove of FIG. 18 in an at rest state.

FIG. 20 is a sectional view of the movable gripping region of the glove of FIG. 18 in a stretched state while in engagement with a ball.

FIG. 21 is a front view of a conventional glove.

FIG. 22 is a sectional view of the glove of FIG. 21 take along line 24-24.

FIG. 23 is a front view of another implementation the glove of FIG. 1 overlaid with respect to the glove of FIG. 21.

FIG. 24 is a sectional view of the glove of FIG. 23 taken along line 24-24.

FIG. 25 is a front view of another implementation of the glove of FIG. 1.

FIG. 26 is a sectional view of the glove a FIG. 25 taken along line 26-26.

FIG. 34 is a perspective view of gloves worn by a person during catching of a football.

FIG. 35 is a front perspective view of the gloves of FIG. 34 in the position shown in FIG. 34.

DETAILED DESCRIPTION OF THE EXAMPLE EMBODIMENTS

Figure 5:
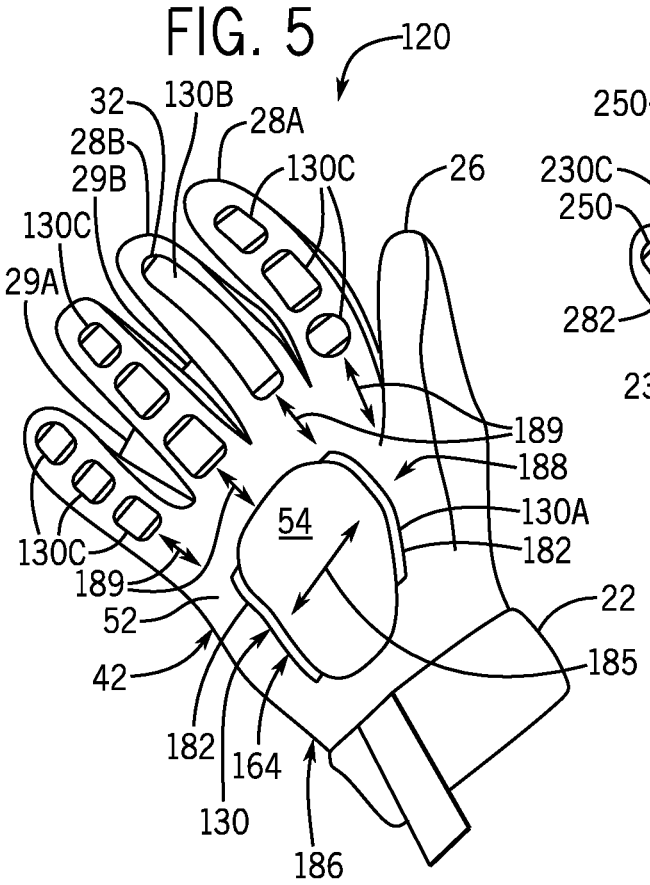
FIG. 5 is a front perspective, palm side view of another implementation of the glove of FIG. 1.

FIGS. 1 and 2 illustrate an example glove 20. Glove 20 facilitates the catching of balls or other projectiles. In one implementation, glove 20 comprises a glove for use during American football, wherein glove 20 facilitates the reception of a thrown football. Glove 20 comprises wrist portion 22, palm portion 24, thumb stall 26, finger stalls 28A, 28B, 28C and 28D (collectively referred to as finger stalls 28), webs 29A, 29B (collectively referred to as webs 29) and movable gripping regions 30A, 30B and 30C (collectively referred to as MGRs 30).

Wrist portion 22 comprises that portion of glove 20 configured to extend about and receive a person's wrist below a base of a person's palm and hand. In one example, wrist portion 22 comprises an open slit 38 and a securement strap 40. Securement strap 40 extends across the slit 38 is releasably secured to an outer surface of a remainder of wrist portion 22 by a hook and loop fastener. Securement strap 40 allows the diameter of the opening of wrist portion 22 to be adjusted. In other implementations, wrist portion 22 may omit slit 38 and strap 40. For example, in one implementation, wrist portion 22 may be elastic or resiliently flexible to stretch when accommodating differently sized wrists. In another implementation, wrist portion 22 may have a single established size based upon the dimensions of the other portions of glove 20. In other implementations, other forms of securements can be used such as, for example, one or more snaps or buckles.

Palm portion 24 extends from wrist portion 22. Palm portion 24 receives the palm and backside of a person's hand. Palm portion 24 comprises a palm side 42 (shown in FIG. 2) and a backside 44 (shown in FIG. 1).

Thumb stall 26 comprise a generally tubular structure extending from palm portion 24 and is located relative to finger stalls 28 so as to receive a person's thumb when glove 20 is fit onto a hand. Finger stalls 28 comprise tubular structures extending from palm portion 24 to receive a person's fingers when glove 20 is fit onto a hand. Finger stall 28A comprises an index finger stall located and size to receive a person's index finger. Finger stall 28B comprises a middle finger stall to receive a person's middle finger. Finger stall 28C comprises a ring finger stall to receive a person's ring finger. Finger stall 28D comprises a pinky stall to receive a person's pinky finger.

Webs 29 comprise bands of flexible material extending between consecutive finger stalls 28. Webs 29 each have a palm side surface that is substantially coplanar or spatially contiguous with the palm side surface of the adjacent stalls 28. As a result, webs 29 provide a larger surface for contacting a football during a reception (i.e., a caught football). In the example illustrated, web 29A extends between pinky finger stall 28D and ring finger stall 28C. Web 29B extends between ring finger stall 28C and middle finger stall 28B. Webs 29 enhance catching of a projectile, such as a football. In one implementation, webs 29 are perforated. In yet another implementation, webs 29 are imperforate. In yet other implementations, webs 29 may be located between other finger stalls or may be located between finger stall 28A and the adjacent thumb stall 26. In still other implementations, webs 29 may be omitted.

Movable gripping regions (MGRs) 30 comprises individual regions along the palm side 42 of glove 20 (as shown in FIG. 2) that are configured to contact a thrown projectile, such as a thrown football, and to subsequently move relative to remaining portions of glove 20 while receiving or catching the thrown (or kicked) projectile or football. Because MGRs 30 move relative to remaining portions of glove 20, MGRs 30 remain in contact with the football (or other projectile) for a prolonged period of time and are less likely to become separated from the football as the glove (and hand) absorb the impact of the thrown or kicked football. Consequently, glove 20 enhances a person's ability to catch the football and to maintain and hold onto the football after the catch.

FIGS. 3 and 4 illustrate an example of one of MGRs 30. As shown by FIG. 3, each MGR 30 comprises a base layer 50, cover layer 52 and gripping layer 54. Base layer 50 comprises one or more layers of resiliently stretchable and bendable elastic material which form the innermost surfaces of glove 20. In one implementation, base layer 50 is formed from an elastic fabric material such as elastane (e.g., Lycra®) or nylon. In yet other implementations, base layer 54 can be formed from other elastic fabric materials or other elastic non-fabric materials. Base layer 50 serves as a foundation for cover layer 52 and gripping layer 54. Base layer 50 cooperates with an overlying cover layer 52 to form a base wall 60 about MGR 30. Base layer 50 cooperates with an overlying gripping layer 54 to form a gripping panel 62 of MGR 30. Those portions of base layer 50 extending between cover layer 52 and gripping panel 54, not supporting or covered by either cover layer 52 or gripping panel 54, form an intermediate elastic web 64 extending between base wall 60 and gripping panel 62 to resiliently retain gripping panel 62 in place until gripping panel 62 encounters the force of a contacted football (or other projectile). In the example illustrated, elastic web 64, when in a default unstretched or less stretched state, generally equidistantly supports gripping panel 62 between edges of cover layer 52. Elastic web 64 can have reverse folds or bends on opposite sides of gripping panel 62 such that elastic web 64 is stacked between or sandwiched between base wall 60 and gripping panel 62, lessening the exposure of elastic web 64 beyond gripping panel 62. The extent to which elastic web 64 projects beyond gripping layer 54 and gripping panel 62 (formed by the stack of base layer 50 and gripping layer 54) will vary depending upon the amount of movement intended for gripping panel 62.

Cover layer 52 overlies areas or portions of base layer 52 rigidifying such portions of base layer 50. Cover layer 52 and the base layer 50, together, form base wall 60 which has a lower degree of elasticity as compared to the elasticity of elastic web 64. As a result, when gripping panel 62 encounters force from a contacted football, elastic web 64 resiliently flexes or moves relative to base wall 60. In one implementation, cover layer 52 comprises a layer of resilient rubber or rubber-like polymer, such as silicone coated, bonded or otherwise joined to an exterior surface of base layer 50. In yet another implementation, cover layer 52 comprise a layer of suede, leather, synthetic leather or other similar material which is breathable, but which has a lesser degree of stretchability or a greater degree of rigidity as compared to base layer 50 itself. For purposes of this disclosure, the term "exterior" refers to the outermost surface or the surface of a layer or structure farthest from the interior of glove 20. In some implementations, cover layer 52 is smooth or flat. In other implementations, cover layer 52 may include raised gripping projections, ribs, grooves or other structures. In addition to securing one end or side of elastic web 64, cover layer 52 may provide additional durability, impact absorption, moisture resistance, moisture absorption and/or an enhanced gripping surface to the underlying base layer 50.

Gripping layer 54 comprises a layer of one or more materials overlying an area or portion of base layer 50. Gripping layer 54 and the underlying portion of base layer 50, together, form gripping panel 62. Gripping layer 54 and the underlying portion of base layer 50, together, can have any elasticity or rigidity greater than base layer 50 alone. As a result, when gripping layer 54 encounters force from a ball being caught, elastic web 64 resiliently flex or moves relative to gripping panel 62. Elastic web 64 moves or slides prior to stretching or deformation of gripping layer 54.

In one implementation, gripping layer 54 comprises a layer of highly grippable material, such as, for example, resilient rubber or rubber-like polymer or silicone coated, bonded or otherwise joined to an exterior surface of base layer 50. In one implementation, gripping layer comprises a layer of suede, leather or other material that is breathable, but which has a greater rigidity, a lesser flexibility or a lower level elasticity as compared to base layer 50 itself. In the example illustrated, gripping layer 54 comprises a rubber-like non-fabric outer surface, wherein a majority of the gripping layer is nonporous. In one implementation, gripping layer 54 is smooth and flat. Because gripping layer 54 is smooth or flat, gripping layer 54 has an exterior surface that provides a greater surface area for contacting a caught football (or other ball or projectile). In other implementations, gripping layer 54 may have a dimpled, serrated or other surface configuration. Gripping layer 54 has an outer surface having a coefficient of friction that is greater than the coefficient of friction of base material 50. The static coefficient of friction of the material used for the gripping layer 54, the cover layer and the base layer can be measured in accordance with ASTM Standard D-1894-11 entitled "Standard Test Method for Static and Kinetic Coefficients of Friction of plastic Film and Sheeting" promulgated by ASTM International located at 100 Barr Harbor Drive, West Conshohocken, Pa. 19428-2959. In one implementation, gripping layer 54 is inelastic. In yet another implementation, gripping layer 54 has an elasticity, but is less elastic than elastic web 64, meaning that elastic web 64 will stretch or bend in response to a lesser force as compared to gripping layer 54.

As further shown by FIG. 3, in the example illustrated, glove 20 further comprises perforations 70, 72. Perforations 70 comprise apertures that extend completely through both gripping layer 54 and the underlying portion of base layer 50 or through both cover layer 52 and the underlying portion of base layer 50. Perforations 72 comprise apertures that extend completely through either gripping layer 54 or cover layer 52, but which terminate prior to extending into our through underlying base layer 50. Perforations 70, 72 provide enhanced breathability to glove 20 even in those portions of glove 20 which are covered or otherwise coated with an otherwise unbreakable non-fabric layer, such as gripping layer 54 or possibly cover layer 52. In other implementations, one or both of perforations 70, 72 may be omitted or may be provided in other locations or with other densities.

FIG. 4 illustrates movement of the example MGR 30 in response to receiving and absorbing force from a football 74 contacting the exterior gripping panel 62. As shown by FIG. 4, during such impact with football 74 moving in the direction indicated by arrow 76, gripping panel 62 also moves in the direction indicated by arrow 76, sliding along and substantially parallel to the adjacent base walls 60. During such movement, gripping panel 62 remains in contact with the exterior of football 74. The right and left portions of elastic web 64 roll to the right with the right portion of elastic web 64 increasing the length of its fold over base wall 60 while the left portion of elastic web 64 unfolds to the right. After the ball is caught and forces in the direction of arrow 76 are no longer being absorbed by gripping panel 62 or when football 74 is no longer in contact with gripping panel 62, elastic web 64 resiliently returns gripping panel 60 the initial state shown in FIG. 3.

As shown by FIG. 2, MGR 30A comprises a palm patch located at the palm of palm portion 24 between the base of finger stalls 28 and wrist portion 22. In the example illustrated, elastic web 64 continuously and completely surrounds gripping panel 62. As a result, gripping panel 62 of MGR 30A is a movable relative to the surrounding base wall 60 in any direction along the palm side face of glove 20 as indicated by arrows 80. Although MGR 30A is illustrated as comprising a single continuous patch or gripping panel 54, in other implementations, MGR 30A alternatively comprise multiple spaced individual patches or gripping panels 62 at various positions across the palm portion 24. Additionally, although MGR 30A is shown at the center of the palm portion 24 of the glove 20, in another implementation, MGR 30A can be positioned closer to the juncture of the index finger stall 28A and the thumb stall 26. In other implementations, MGR 30A can be positioned in other locations about the palm portion 62. Additionally, the other MGRs can also be positioned in other locations about the palm side of the glove 20. Still further, one or more of the MGRs can be removed from palm side of the glove. FIG. 2 illustrates one arrangement of MGRs. In alternative implementations, other arrangements including alternate sizes, shapes, and numbers of MGRs can be applied to the glove 20 to facilitate the catching, grasping and retention of the football.

MGR 30B (or 38B) comprises a finger patch located on middle finger stall 28B. MGR 38B continuously extends from a base of the middle finger stall 28B to a tip of middle finger stall 28B. MGRs 30C comprise a series of finger patches spaced along each of index finger stall 28A, ring finger stall 28C and pinky finger stall 28D. As with MGR 30A, each of MGRs 30B (38B) and 30C comprise a gripping panel 62 completely and continuously surrounded by elastic web 64, facilitating relative movement of gripping panel 62 relative to the surrounding base wall 60 as described above with respect to FIGS. 3 and 4. As a result, each of the MGRs 30 located on finger stalls 28 move with the ball being contacted to prolong the time that the ball is contacted and to enhance the likelihood that the ball will be retained and caught.

FIG. 5 illustrates glove 120, another implementation of glove 20. Glove 120 is similar to glove 20 except that glove 120 comprises movable gripping regions (MGR) 130 in lieu of movable gripping regions 30. Those remaining components of glove 120 which correspond to components of glove 20 are numbered similarly.

Movable gripping regions 130 are similar to movable gripping regions 30 except that MGRs 130 do not include an elastic web 64 that completely and continuously surrounds gripping panel 62, but instead include an elastic web 164 comprised of multiple spaced portions at particular points along or about gripping panel 62 so as to limit or control the direction or directions in which gripping panel 62 is permitted to move relative to base walls 60 of glove 120. In one implementation, elastic web 164 comprises an elastic fabric material such as elastane (e.g., Lycra®) or nylon. In other implementations, elastic web 164 may comprise other fabric and non-fabric elastic or resiliently stretchable materials. In the example illustrated, each MGR 130 comprises a pair of opposing elastic web portions 182. Elastic web portions 182 extend on opposite edges are opposite sides of the associated gripping panel 62 such that the elastic web 164 provides uniaxial elasticity. In other words, elastic web 164 largely limits relative movement of the associated gripping panel 162 along a single axis. In the example illustrated, MGR 130A facilitate relative movement of its gripping panel 62 along an axis 185 that diagonally extends between a left corner 186 of a base of the palm side of palm portion 24 and a thenar space or region 188 between thumb stall 26 and index finger stall 28A. In the example illustrated, MGRs 130B, 130C and 130D facilitate relative movement of their gripping panel 62 along respective axes 189 that longitudinally extend along each of the respective finger stalls 28. By controlling such movement along the noted axes, catching performance is enhanced. In other implementations, movement of the gripping panel 62 of the particular MGRs 130 may be controlled along other designated or preselected axes.

Figure 6:
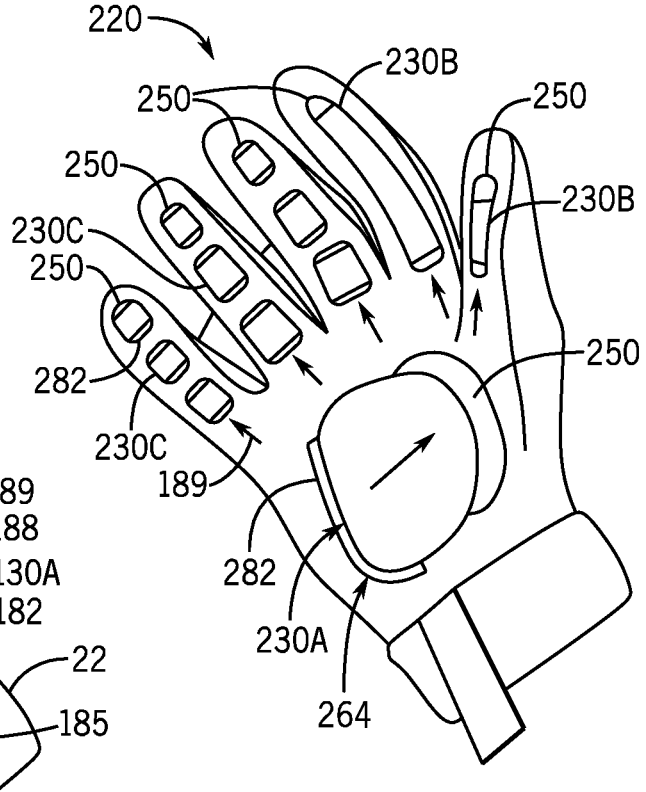
FIG. 6 is a front perspective, palm side view of another implementation of the glove of FIG. 1.
Figure 7:
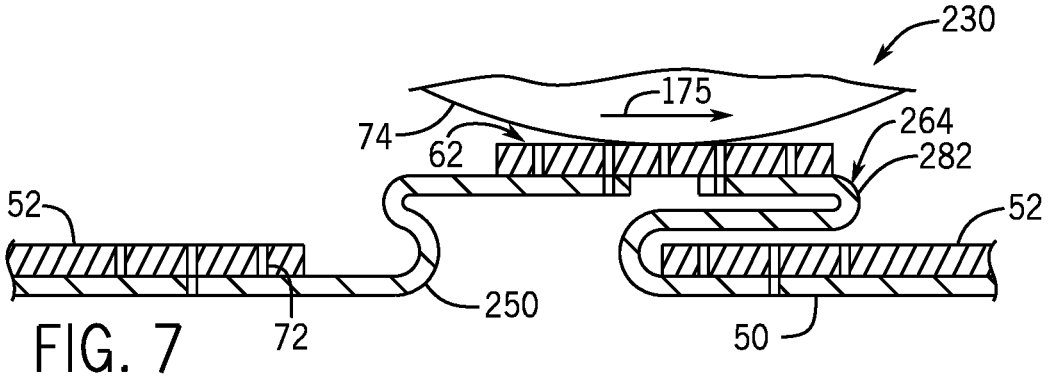
FIG. 7 is a sectional view of a movable gripping region of the glove of FIG. 6 while in engagement with a ball.
Figure 8:
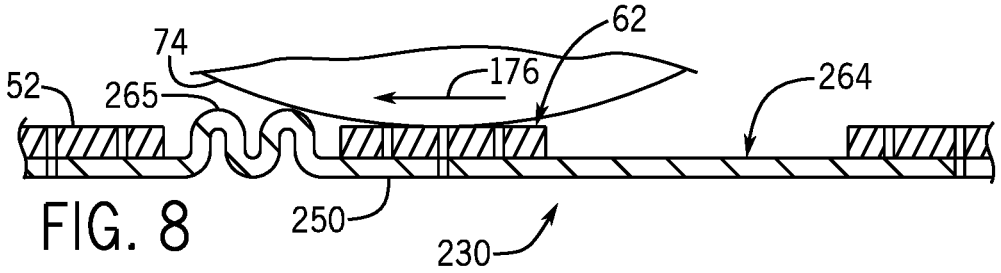
FIG. 8 is a sectional view of the movable gripping region of the glove FIG. 6 in a stretched state while in engagement with a ball.

FIGS. 6-8 illustrate glove 220, another implementation of glove 20. Glove 220 is similar to glove 20 except that glove 220 comprises movable gripping regions (MGR) 230 in lieu of movable gripping regions 30. Those remaining components of glove 220 which correspond to components of glove 20 are numbered similarly.

Movable gripping regions 230 are similar to movable gripping regions 30 except that MGRs 230 do not include an elastic web 64 that completely and continuously surrounds gripping panel 62, but instead include an elastic web 264 comprised of one or more web portions on a single side of gripping panel 62 so as to limit or control movement of gripping panel 62 to largely one direction relative to base walls 60 of glove 220 when receiving force in the one direction from a ball that is being caught. In one implementation, elastic web 264 comprises an elastic fabric material such as elastane (e.g., Lycra®) or nylon. In other implementations, elastic web 264 may comprise other fabric and non-fabric elastic or resiliently stretchable materials. In the example illustrated, glove 220 comprises a base layer 250 on an opposite side of the gripping panel 62 that is less elastic and nominally inelastic as compared to base layer 50 and elastic web 264. Like elastic web 264, layer 250 is flexible or foldable. As a result, such inelastic portions of layer 250 will not move or will move to a lesser extent in the direction indicated by arrow 175 from the at rest state shown in FIG. 6, but will fold up as the elastic web 264 unfolds and stretches from the at rest state shown in FIG. 6 during movement in the direction indicated by arrow 176 in FIG. 8. Consequently, gripping panel 62 is more apt to move in one direction than the other opposite direction.

In the example illustrated, each MGR 230 comprises single elastic web portion 282. Elastic web portion 282 extends on one edge or one side of the associated gripping panel 62 such that the elastic web 264 provides unidirectional elasticity. In other words, elastic web 264 is stretchable and unfoldable or rollable in a single direction to largely limit relative movement of the associated gripping panel 162 along a single axis in a single direction.

FIGS. 7 and 8 illustrate movement of the example MGR 230 in response to receiving and absorbing force from a football 74 contacting the exterior gripping panel 62. As shown by FIG. 8, during such impact with football 74 moving in the direction indicated by arrow 176, gripping panel 62 also moves in the direction indicated by arrow 176, sliding along and substantially parallel to the adjacent base walls 60. During such movement, gripping panel 62 remains in contact with the exterior of football 74. Portion 282 of elastic web 164 rolls and unfolds to the left with inelastic, but flexible portions of glove 220 on the opposite side of gripping panel 62 folding up. After the ball is caught and forces in the direction of arrow 76 are no longer being absorbed by gripping panel 62 or when football 74 is no longer in contact with gripping panel 62, elastic web 264 resiliently returns gripping panel 62 to the initial state shown in FIG. 7.

In the example illustrated, MGR 230A facilitates relative movement of its gripping panel 62 along an axis 185 in a single direction that diagonally extends from a left corner 186 of a base of the palm side of palm portion 24 to a thenar region 188 between thumb stall 26 and index finger stall 28A. In the example illustrated, MGRs 130B, 130C and 130D facilitate relative movement of their gripping panel 62 in a single direction along respective axes 189 towards the tips of finger stalls 28. By controlling such movement along the noted axes, catching performance is enhanced. In other implementations, movement of the gripping panel 62 of the particular MGRs 230 may be limited to other directions by locating one or more elastic web portions 282 at other locations with respect to the associated gripping panel 62.

Figure 9:
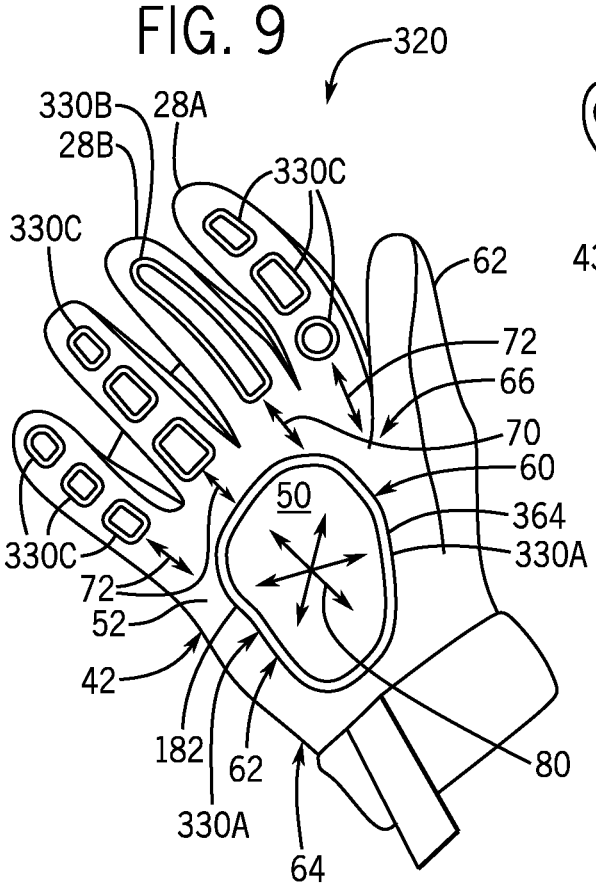
FIG. 9 is a front perspective, palm side view of another implementation of the glove of FIG. 1.
Figure 10:
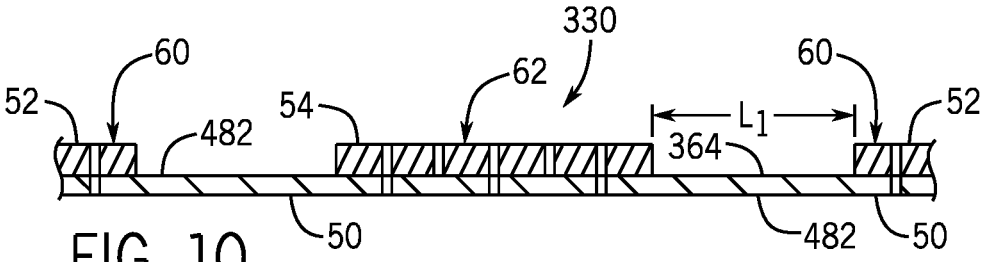
FIG. 10 is a sectional view of a movable gripping region of the glove of FIG. 9 in an at rest state.
Figure 11:
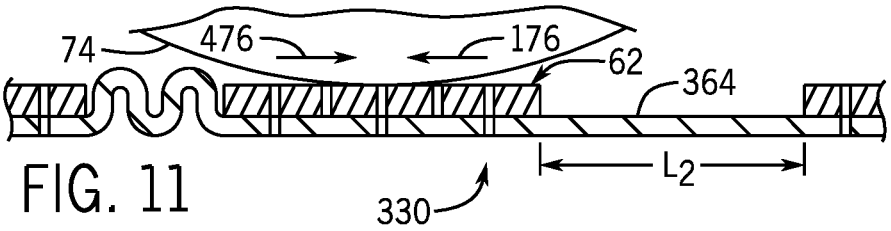
FIG. 11 is a sectional view of the movable gripping region of the glove of FIG. 9 in a stretched state while in engagement with a ball.
Figure 27:
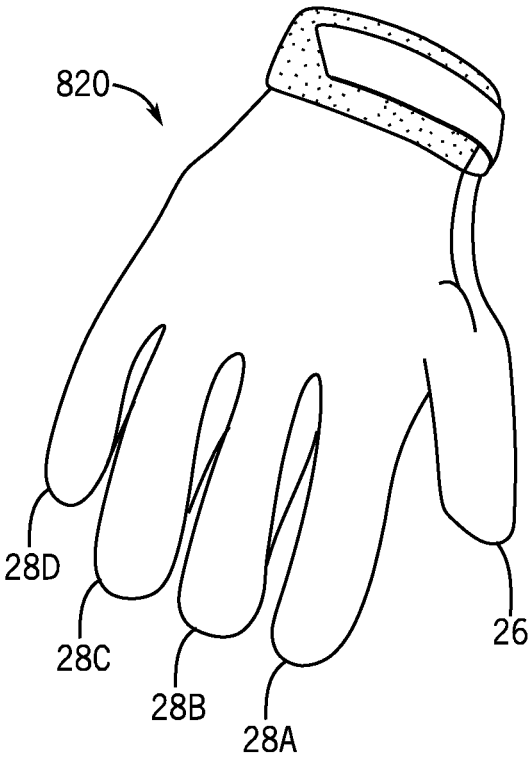
FIG. 27 is a rear perspective view of another implementation of the glove of FIG. 1.

FIG. 9 illustrates glove 320, another implementation of glove 20. Glove 320 similar to glove 20 except that glove 320 comprises MGRs 330 in lieu of MGRs 30. Those remaining components of glove 320 which correspond to components of glove 20 are numbered similarly. As shown by FIGS. 10 and 11, MGRs 330 are similar to MGRs 30 except that MGRs 330 comprise elastic web 364 in lieu of elastic web 64. Elastic web 364 is similar to elastic web 64 except that elastic web 364 is not folded as shown in FIG. 3 in its default, at rest state. Elastic web 364 can have sufficient elasticity or stretchability to provide a desired extent of movement without being folded or wrapped. In one implementation, elastic web 364 comprises an elastic fabric material such as elastane (e.g., Lycra®) or nylon. In other implementations, elastic web 364 may comprise other fabric and non-fabric elastic or resiliently stretchable materials. As shown by FIG. 11, in response to contacting a ball, such as football 74, and receiving force from the football in the direction indicated by arrow 176, the right side (as seen in FIG. 11) of elastic web 364 resiliently stretches from a less stretched or unstretched state having a length L1 three more stretched state having a length L2. As a result, gripping panel 62 moves to the left by the distance L2-L1. At the same time, the left side (as seen in FIG. 11) of elastic web 364 bends, folds or collapses to accommodate such leftward movement of gripping panel 62. After the ball is caught and forces in the direction of arrow 176 are no longer being absorbed by gripping panel 62 or when football 74 is no longer in contact with gripping panel 62, elastic web 364 resiliently returns gripping panel 62 the initial state shown in FIG. 10.

As shown by FIG. 9, MGR 330A comprises a palm patch located at the palm of palm portion 24 between the base of finger stalls 28 and wrist portion 22. In the example illustrated, elastic web 364 continuously and completely surrounds gripping panel 62. As a result, gripping panel 62 of MGR 330A is a movable relative to the surrounding base wall 60 in any direction along the palm side face of glove 20 as indicated by arrows 80. Although MGR 330A is illustrated as comprising a single continuous patch or gripping panel 62, in other implementations, MGR 330A alternatively comprises multiple spaced individual patches or gripping panels 62 at various positions across the palm side of palm portion 24.

MGR 330B comprises a finger patch located on middle finger stall 28B. MGR 330B continuously extends from a base of the middle finger stall 28B to a tip of middle finger stall 28B. MGRs 330C comprise a series of finger patches spaced along each of index finger stall 28A, ring finger stall 28C and pinky finger stall 28D. As with MGR 330A, each of MGRs 30B and 30C comprise a gripping panel 62 completely and continuously surrounded by elastic web 364, facilitating relative movement of gripping panel 62 relative to the surrounding base wall 60 as described above with respect to FIGS. 10 and 11. As a result, each of the MGRs 330 located on finger stalls 28 move with the ball being contacted to prolong the time that the ball is contacted and to enhance the likelihood that the ball will be retained and caught.

Figure 12:
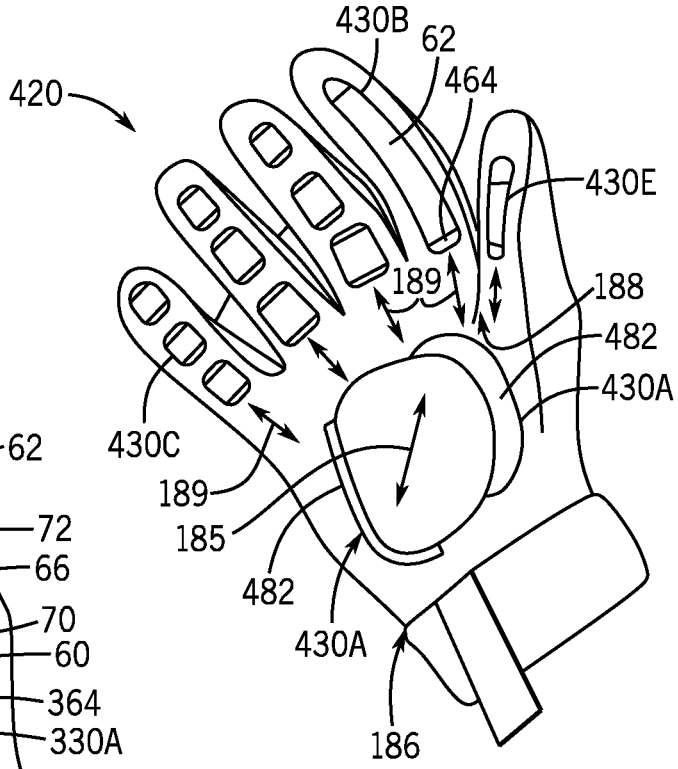
FIG. 12 is a front perspective, palm side view of another implementation of the glove of FIG. 1.

FIG. 12 illustrates glove 420, another implementation of glove 320. Glove 420 is similar to glove 20 except that glove 420 comprises movable gripping regions (MGR) 430 in lieu of movable gripping regions 330. Those remaining components of glove 420 which correspond to components of glove 320 are numbered similarly.

Movable gripping regions 430 are similar to movable gripping regions 330 except that MGRs 430 do not include an elastic web 364 that completely and continuously surrounds gripping panel 62, but instead include an elastic web 464 comprised of multiple spaced portions at particular points along or about gripping panel 62 so as to limit or control the direction or directions in which gripping panel 62 is permitted to move relative to base walls 60 of glove 420. In one implementation, elastic web 464 comprises an elastic fabric material such as elastane (e.g., Lycra®) or nylon. In other implementations, elastic web 464 may comprise other fabric and non-fabric elastic or resiliently stretchable materials. In the example illustrated, each MGR 430 comprises a pair of opposing elastic web portions 482. Elastic web portions 482 extend on opposite edges are opposite sides of the associated gripping panel 62 such that the elastic web 464 provides uniaxial elasticity. In other words, elastic web 464 largely limits relative movement of the associated gripping panel 62 along a single axis. In the example illustrated, MGR 430A facilitate relative movement of its gripping panel 62 along an axis 185 that diagonally extends between a left corner 186 of a base of the palm side of palm portion 24 and a thenar region 188 between thumb stall 26 and index finger stall 28A. In the example illustrated, MGRs 430B, 430C and 430D facilitate relative movement of their gripping panel 62 along respective axes 189 that longitudinally extend along each of the respective finger stalls 28. With glove 420, an additional MGR 430E (similar to MGR 430B) is provided on the palm side of thumb stall 26. By controlling such movement along the noted axes, catching performance is enhanced. In other implementations, movement of the gripping panel 62 of the particular MGRs 430 may be controlled along other designated or preselected axes.

In yet other implementations, one of elastic web portions 482 (and the corresponding portion of base layer 50) may be replaced with a less elastic or inelastic flexible, bendable or foldable material similar to that of base layer 250 described above with respect to glove 220). In such an alternative implementation, unidirectional movement of gripping panel 62 is facilitated, wherein gripping panel 62 is more apt to move in one direction along an axis versus the other direction along the same axis. For example, in one implementation, the left elastic web portion 42 shown in FIG. 10 may be replaced with a less elastic or inelastic flexible, bendable or foldable material, such as an elastic fabric. In such an implementation, gripping panel 62 may still move to the left (from the at rest or default state shown in FIG. 10) in the direction of arrow 176 when gripping panel 62 receives force from a caught football 74 also moving in the direction indicated by arrow 176. However, gripping panel 62, when receiving force from an engaged football 74 moving in a direction indicated by arrow 476 will not move to the right or resist substantial movement to the right more so than movement to the left as the less elastic or inelastic flexible, bendable or foldable material will not stretch or will stretch to a much lesser degree as compared to the right elastic portion 482.

FIGS. 13-16 illustrate glove 520, another example implementation of glove 20. Glove 520 is similar to glove 20 except that glove 520 comprises MGRs 530 in lieu of MGRs 30. Those remaining components of glove 520 which correspond to components of glove 20 are numbered similarly. As shown by FIGS. 15 and 16, MGRs 530 are similar to MGRs 30 except that MGRs 530 omit cover layer 52 and gripping layer 54 and comprise base layer 550 in lieu of base layer 50. Base layer 550 comprises a single layer or one or more laminated layers having different sections with different characteristics such as different degrees of elasticity, rigidity, coefficient of friction, breathability and the like. In one implementation, the different sections may be bonded, stitched, welded or otherwise joined together in an end to end or overlapping fashion. In another implementation, the different sections may comprise a single integral layer having different treatments and/or infusions, coatings and the like applied thereto so as to provide the different sections with different characteristics. In the example illustrated, base layer 550 comprises base wall 560, gripping panel 562 and elastic web 564.

In one implementation, base wall 560 can be formed with a lower degree of elasticity as compared to the elasticity of elastic web 564. As a result, when gripping panel 562 encounters force from a contacted football, elastic web 564 resiliently flexes, extends or moves relative to base wall 560. In one implementation, base wall 560 comprises a layer of resilient rubber or rubber-like polymer, such as silicone. In yet another implementation, base wall 560 comprises a layer of suede, leather, synthetic leather or other similar material which is breathable, but which has a lesser degree of stretchability or a greater degree of rigidity as compared to elastic web 564. In some implementations, base wall 560 is smooth or flat. In other implementations, base wall 560 may include raised gripping projections, ribs, grooves or other structures.

Gripping panel 562 comprises a layer of one or more materials having an elasticity or rigidity less than elastic web 564. As a result, when gripping panel 562 encounters force from a ball being caught, elastic web 564 resiliently flexes or moves relative to gripping panel 562. Elastic web 564 moves or slides prior to stretching or deformation of gripping layer 54.

In one implementation, gripping panel 562 comprises a layer of resilient rubber or rubber-like polymer, such as silicone. In one implementation, gripping panel 562 comprises a layer of suede, leather or other material that is breathable, but which has a greater rigidity, a lesser flexibility or a lower level elasticity as compared to elastic web 564 itself. In the example illustrated, gripping panel 562 comprises a rubber-like non-fabric outer surface, wherein a majority of the gripping layer is nonporous. In one implementation, gripping panel 562 is smooth and flat. Because gripping panel 562 is smooth or flat, gripping panel 562 has an exterior surface that provides a greater surface area for contacting a caught football (or other ball or projectile). In other implementations, gripping panel 562 may have a dimpled, serrated or other surface configuration. Gripping panel 562 has an outer surface having a coefficient of friction that is greater than the coefficient of friction of base layers 560. In one implementation, gripping panel 562 is inelastic. In yet another implementation, gripping panel 562 has an elasticity, but is less elastic than elastic web 564, meaning that elastic web 564 will stretch or bend in response to a lesser force as compared to gripping panel 562.

Elastic web 564 comprises one or more layers of resiliently stretchable and bendable elastic material which form the innermost surfaces of glove 520. In one implementation, elastic web 564 is formed from an elastic fabric material such as elastane (e.g., Lycra®) or nylon. In yet other implementations, elastic web 564 is formed from other elastic fabric materials are other elastic non-fabric materials. Elastic web 64 extends between base wall 560 and gripping panel 562 to resiliently retain gripping panel 562 in place until gripping panel 562 encounters the force of a contacted football (or other projectile). In the example illustrated, elastic web 564, when in a default unstretched or less stretched state, equidistantly supports gripping panel 562 between edges of base wall 560. As shown by FIG. 15, elastic web 564 has reverse folds or bends on opposite sides of gripping panel 562 such that elastic web 564 is stacked between or sandwiched between base wall 560 and gripping panel 562, lessening the exposure of elastic web 564 beyond gripping panel 562. The extent to which elastic web 564 projects beyond gripping layer 554 and gripping panel 562 will vary depending upon the amount of movement intended for gripping panel 562.

FIG. 16 illustrates movement of the example MGR 530 in response to receiving and absorbing force from a football 74 contacting the exterior gripping panel 562. As shown by FIG. 16, during such impact with football 74 moving in the direction indicated by arrow 576, gripping panel 562 also moves in the direction indicated by arrow 576, sliding along and substantially parallel to the adjacent base walls 560. During such movement, gripping panel 562 remains in contact with the exterior of football 74. The right and left portions of elastic web 564 roll to the right with the right portion of elastic web 564 increasing the length of its fold over base wall 560 while the left portion of elastic web 564 unfolds to the right. After the ball is caught and forces in the direction of arrow 576 are no longer being absorbed by gripping panel 562 or when football 74 is no longer in contact with gripping panel 562, elastic web 564 resiliently returns gripping panel 562 to the initial state shown in FIG. 15.

FIGS. 17-20 illustrate glove 620, another implementation of glove 20. Glove 620 is similar to glove 20 except that glove 620 comprises MGRs 630 in lieu of MGRs 30. Those remaining components of glove 620 which correspond to components of glove 20 are numbered similarly. MGRs 630 comprises individual regions along the palm side of glove 620 (as shown in FIG. 18) that are configured to contact a thrown projectile, such as a thrown football, and to subsequently move relative to remaining portions of glove 620 while remaining in contact with the thrown projectile or football. Because MGRs 630 move relative to remaining portions of glove 620, MGRs 630 remain in contact with the football (or other projectile) for a prolonged period of time in a less likely to become separated from the football as the glove (and hand) absorb the impact of the football. Consequently, glove 620 enhances a person's ability to catch and maintain hold of the football being caught.

FIG. 19 is an enlarged sectional view illustrating a portion of one of MGRs 630. As shown by FIG. 19, each of MGRs 630 comprises a series or array of gripping panels 662 resiliently retained in a corrugated edge to edge relationship by a corresponding series or array of elastic webs 664. In one implementation, each gripping panel 662 comprises a layer of one or more materials having an elasticity or rigidity less than elastic web 664. As a result, when gripping panels 662 encounter force from a ball being caught, elastic webs 664 resiliently flex or move relative to gripping panel 662. Elastic web 664 moves or stretches prior to stretching or deformation of the gripping panel 662.

In one implementation, each gripping panel 662 comprises a layer of resilient rubber or rubber-like polymer, such as silicone. In one implementation, gripping panels 662 comprises a layer of suede, leather or other material that is breathable, but which has a greater rigidity, a lesser flexibility or a lower level elasticity as compared to elastic web 564 itself. In the example illustrated, gripping panel 662 comprises a rubber-like non-fabric outer surface, wherein a majority of the gripping panel 662 is nonporous. In one implementation, gripping panel 662 is smooth and flat. Because gripping panel 662 is smooth or flat, gripping panel 662 has an exterior surface that provides a greater surface area for contacting a caught football (or other ball or projectile). In other implementations, gripping panel 662 may have a dimpled, serrated or other surface configuration. Gripping panel 662 has an outer surface having a coefficient of friction that is greater than the coefficient of friction of elastic webs 664. In one implementation, gripping panel 662 is inelastic. In yet another implementation, gripping panel 662 has an elasticity, but is less elastic than elastic web 664, meaning that elastic webs 664 will stretch or bend in response to a lesser force as compared to the force that initiates stretching or bending of gripping panel 662.

Elastic webs 664 each comprise one or more layers of resiliently stretchable and bendable elastic material. In one implementation, each elastic web 664 is formed from an elastic fabric material such as elastane (e.g., Lycra®) or nylon. In yet other implementations, elastic web 664 is formed from other elastic fabric materials or other elastic non-fabric materials. Elastic webs 64 extend between gripping panels 662 to resiliently retain gripping panels 662 in place in the elevated position, default or at rest position shown in FIG. 19 until gripping panels 662 encounters the force of a contacted football (or other projectile). In the example illustrated, elastic web 664, when in a default unstretched or less stretched state, supports gripping panels 662 and an edge to edge or side-by-side state in which the edges or sides gripping panels 662 abut or contact one another. In other implementations, elastic web 664 may alternatively retain gripping panels 662 with spacings between the edges of gripping panel 662. Although elastic webs 664 are illustrated as supporting and retaining gripping panels 662 in a single plane such that gripping panels 662 are coplanar, in other implementations, elastic webs 664 may alternatively support 662 in different step planes or may be configured such that a first portion of the gripping panels 662 resiliently flatten in response to contacting a ball prior to or in response to a lesser force as compared to the resilient flattening of other gripping panels 662 also in concurrent contact with the ball.

In the example illustrated, elastic webs 664, are formed by a single continuous base layer 650 of elastic material. Gripping panels 662 are formed by individual gripping layers 654 formed upon spaced portions of base layer 650, wherein the gripping layers 654 inhibit elasticity or resilient stretching of the underlying portions of base layer 650. In one implementation, gripping panels 662 comprise individual coatings of a rubber-like material such as a rubber or silicone deposited, coated or otherwise secured upon spaced portions of base layer 650 well base layer 650 is in a stretched state, wherein release of base layer 650 results in the uncoated portion of the base layer 650 returning to and at rest state shown in FIG. 19 with gripping panels 662 extending side-by-side. In one implementation, gripping panels 662 may be formed by alternatively infusing spaced portions of base layer 650 with the materials of gripping layer 654 or may be formed by selectively treating spaced portions of base layer 650 such that the treated portions have a lowered degree of elasticity. In yet other implementations, gripping layer 654 may be omitted, wherein the corrugated ends of base layer 650 serve as gripping surfaces or gripping panels 662. Although the gripping panels 662 are illustrated at top spaced portions of corrugated elastic webs 664 in FIG. 19, in other implementations, gripping layer 654 and gripping panels 662 extend entirely over webs 664 in the corrugated areas.

FIG. 20 illustrates movement of the example MGR 630 in response to receiving and absorbing force from a football 74 contacting the exterior gripping panels 662. As shown by FIG. 20, during such impact with football 74, gripping panels 662 flatten and slide. During such movement, gripping panels 662 remain in contact with the exterior of football 74 while expanding about football 74. After the ball is caught and forces are no longer being absorbed by gripping panels 662 or when football 74 is no longer in contact with gripping panels 662, elastic webs 664 resiliently return gripping panels 662 to the initial state shown in FIG. 19. In another implementation, the elastic webs 664 may be highly resilient and stretchable such that they lie between or beneath the gripping panels 662 such that the elastic webs 664 do not curve downward in an accordion-like fashion but extend generally coplanar with the gripping panels 662. In such an embodiment, the elastic webs 664 expand or stretch when the gripping panels 662 contact a football.

Due to the accordion-like nature of MGRs 630, MGRs 630 provide uniaxial relative movement between gripping 662 and surrounding portions of glove 620. In the example illustrated, glove 620 comprises a pair of MGRs 630A and 630B on the palm side of palm portion 24, wherein movement or flattening of gripping panels 662 occurs along diagonal axes pointing towards the thenar region 188 between the thumb stall 26 and the index finger stall 28A. Glove 620 further comprises MGRs 630C, 630D, 630E and 630F on the palm side of each of finger stalls 28A, 28B, 28C and 28D, respectively. MGRs 630 on the finger stalls 28 provide uniaxial movement or flattening of gripping panels 662 along longitudinal axes extending from a base of each finger stall to the tip of each finger stall. The uniaxial movement illustrated along the described axes enhances reception of a ball, such as a football. In other implementations, MGRs 630 may be provided at other locations or may provide uniaxial movement in other directions.

As further shown by FIG. 18, glove 620 may include additional MGRs as described above with respect to gloves 20, 120, 220, 320, 420 and 520. In the example illustrated, glove 620 further comprises MGRs 730A, 730B, 730C, 730D and 730E (collectively described as MGRs 730). MGR 730 are substantially similar to MGR 30 described above. MGR 730A is located on the palm side of thumb stall 26. MGR 730B is located on the palm side of index figure stall 28A. MGR 730C is located on the palm side of middle finger stall 28B. MGR 730D is located on the palm side of ring finger stall 28C. Lastly, MGR 730E is located on the palm side of finger stall 28. MGRs 730 provide multidirectional movement profit the tips of thumb stall 26 and figure stalls 28. By combining uniaxial movement along the base of such figure stalls 28 and multidirectional movement proximate to tips of figure stalls 28, catching performance is enhanced.

It is contemplated in the present invention that the MGRs of the above-listed implementations can be used in other combinations, arrangements, sizes and/or number. The locations of the MGRs can also be varied about the gloves. Additionally, size, length, width and elasticity of the elastic webs 64, 164, 264, 363, 464, 564 and 646 can be varied to match a particular application or need. The elastic webs can lie generally in a single plane, or be corrugated, or overlapping or any arrangement. Additionally, the arrangement of layers of the above-listed gloves can be varied. For example, the glove can be formed without a cover layer 52, and without a base wall.

The MGRs 30, 130, 230, 330, 430, 530 and 630 of gloves 20, 120, 220, 320, 420, 520 and 620 serve as a plurality of catches to facilitate the catching or retention of a football. The movement of the MGRs 30, 130, 230, 330, 430, 530 and 630 of gloves 20, 120, 220, 320, 420, 520 and 620 give the gloves a "net-like" characteristic. The MGRs move with the football upon contacting the football while the rest of the glove(s) essentially remains in place on the user's hand(s). Then as the football is caught, the MGRs resilient move back to their at rest position. Accordingly, the MGRs provide additional catching and retention ability not present on conventional sports gloves including football gloves.

FIGS. 21 and 22 illustrate a conventional glove 750. FIG. 21 illustrate the palm side of glove 750. FIG. 22 is a sectional view of glove 750 taken along lines 24-24 of FIG. 21. As shown by FIGS. 21 and 22, glove 750 has finger stalls 751 with a limited palm side forward-most surface area 752 (or facing surface). As shown by FIG. 21, each finger stall 751 has a width W substantially equal to or even less than the expected width of the particular finger to be received by the stall. As shown by FIG. 22, each finger stall 751 has a generally circular or oval cross-sectional shape that closely matches and conforms to the cross-sectional shape of the particular finger (or thumb) received by the stall. As a result, the palm facing surfaces of each finger stall 751 are convex prior to contact with a football and during contact with the football. The convex palm facing surfaces 752 of figure stall 751 further reduce the total surface area that contacts if a ball during catching of the football. Accordingly, the amount of surface area actually contacting the football during catching or retention is limited to the lower surfaces of the generally circular cross-sectional shape of the user fingers and the corresponding finger stalls.

FIGS. 23 and 24 illustrates glove 760 which provides an enhanced and enlarged palm facing surface area for contacting and gripping a football as a football is being caught. As shown by FIG. 23, which illustrates glove 760 overlying glove 750 (shown in broken lines), glove 760 has finger stalls 761 which are wider than a figure stalls 751. Accordingly the overall surface area available for contacting, catching and/or retaining the football is significantly greater than with the conventional glove of FIGS. 21 and 22. Figure stalls 761 have a width greater than a width of the finger being received by the particular stall. As shown by FIG. 24, each finger stall 761 has a palm facing surface 762 having a width Wi greater than the width of the remaining cross-sectional portions of the finger stall 751. Unlike finger stalls 751 shown in FIG. 22 which have a cross-sectional width W that is greatest at a midpoint between the palm side of the stall in the back of the stall 752, finger stalls 761 shown in FIG. 24 have a cross-sectional width that is greatest at the palm side, forward-most football contacting surfaces 762. The cross-sectional widths of figure stall 761 rearward of football contacting surfaces 762 (away from the palm side of the glove) are narrower than the width Wi of the palm facing surface 762. As a result, glove 760 provides a larger surface area which enhances catching performance of glove 760 and the ability of a user to catch and retain a football.

FIGS. 25 and 26 illustrate glove 770 which, like glove 760, provides a larger palm side gripping surface area to enhance gripping and catching of a football. Glove 770 comprises webs 774. As shown by FIG. 26, each web 774 extends on or about the palm side 776 of glove 770 in generally the same plane as or in front of the forward-most palm side surfaces of finger stalls 771. Because the forward-most surfaces 782 of webs 774 are generally coplanar with the forward-most surfaces of finger stall 771, webs 774 provide enhanced and increased surface area for contacting a football, and for gripping or catching the football. In one implementation, figure stalls 771 are similar to figure stalls 761, having palm side forward-most surfaces 762, wherein the front surface of web 774 are generally coplanar with adjacent surfaces 762 of finger stalls 771. In other implementations, stall 771 may be similar to finger stall 751, wherein the front surfaces of web 774 are generally coplanar with the frontward most convex surfaces 752 of finger stalls 771.

FIGS. 27-30 illustrate glove 820, another example implementation of a glove providing a larger surface area for contacting, gripping, catching and/or retaining a football. Glove 820 is similar to glove 20 except that glove 820 comprises one or more flattening gripping regions (FGRs) 830A, 830B, 830C, 830D, 830E, 830F and 830G (collectively referred to as FGRs 830). Those remaining elements or components of glove 820 which correspond to glove 20 are numbered similarly.

Figure 28:
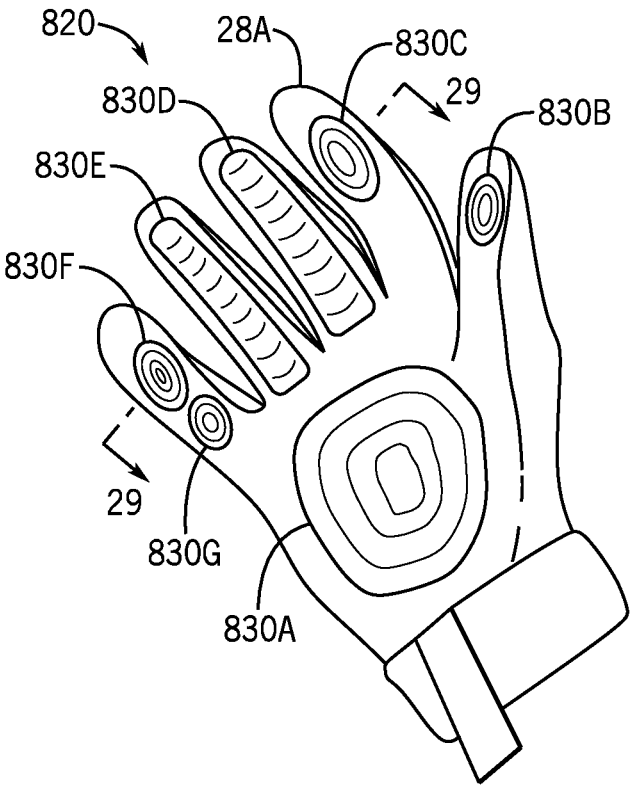
FIG. 28 is a front perspective, palm side view of the glove of FIG. 27.
Figure 29:
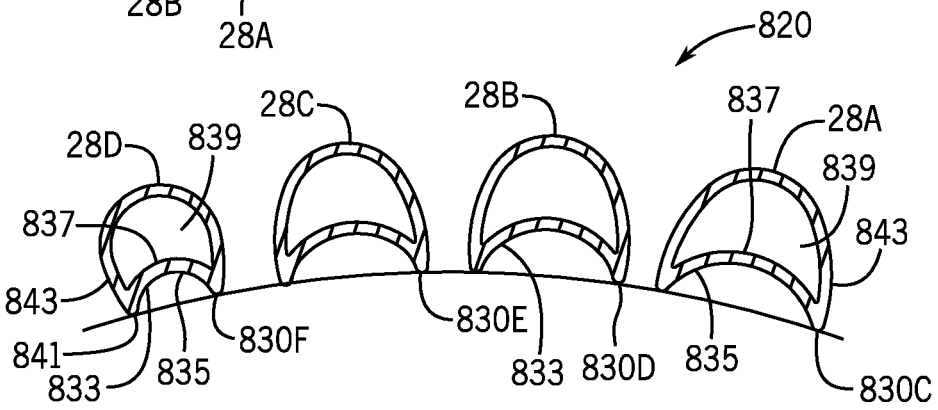
FIG. 29 is a sectional view of an example flattening gripping region of the glove of FIG. 28 in an at rest state.

FGRs 830 comprises individual regions along the palm side of glove 20 (as shown in FIG. 28) that are configured to contact a thrown projectile, such as a thrown football, and to subsequently move and change shape relative to remaining portions of glove 20 while remaining in contact with the thrown projectile or football. FGRs 830 each flatten upon encountering a surface force to increase the surface area provided by each of FGRs 830 in contact with the football (or other ball). FIG. 29 is a sectional view illustrating FGRs 830C, 830D, 830E and 830F. FGRs 830C and 830F are located on the palm side of index finger stall 28A and pinky finger stall 28D, respectively. FGRs 830C and 830F each comprise a circular, concave or oval crater of resiliently flexible material that is resiliently flexible or deformable to a flat state shown in FIG. 30 upon the application of a force or pressure between the user's hand and a football or other external object. FGRs 830A, 830B and 830G can have similar constructions, comprising craters that resiliently flatten to increase the surface area contacting the ball while catching, receiving or retaining the ball. FGRs 830D and 830E are similar to the other FGRs 830 except that FGRs 830D and 830E comprise elongate troughs extending along a longitudinal centerline or major axes of the middle finger stall 28B and the index finger stall 28C.

Figure 30:
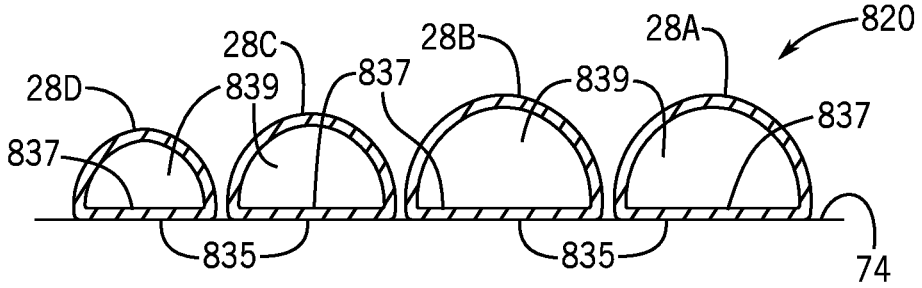
FIG. 30 is a sectional view of the flattening gripping region of the glove of FIG. 29 in a flattened state while in engagement with a ball.

As shown by FIGS. 29 and 30, in the example illustrated, each of movable or flattening gripping regions 830 can form part of the wall (or catching surface area) on the palm side of glove 820. As shown by FIG. 29, each of finger stalls 28A, 28B, 28C and 28D comprises an arcuate wall 833 defining a concave outwardly facing depression 835 and an opposite convex surface 837 which faces and borders an interior 839 of the finger stall 28, wherein surface 837 contacts a received finger of the user. As further shown by FIG. 29, each of walls 833 and the concave depression 835 has a perimeter 841 that continuously extends to sides 843 of the finger stall 28 to us to omit any undercut or overhang beneath the perimeter 841 between the perimeter 841 and the sides 843 of the finger stall 28. As a result, in contrast to independent suction cups projecting from and spaced from the palm side of glove 820, movable gripping regions 830 tactilely (by touch) indicate the state of the particular FGR 830, whether the particular FGR 830 is in and at rest state as shown in FIG. 29 or is in a flat and state as shown in FIG. 30. Moreover, the flattened FGRs 830 are more stable as compared to independently supported suction cups. In other implementations, the concave depressions 835 may be provided by other structures or configurations.

Each concave depression 835 remains in a concave state even when receiving a person's fingers. Upon encountering an external force or pressure from engaging an external surface (pressure applied between the user's hands and the football—pressure can be from the user's hands, the football or both), such as a football, concave depressions 835 resiliently flatten to increase the surface area of each FGR 830 in contact with the ball. When the concave depressions 835 are no longer being pressed against the wall, such as when the ball is dropped or released, concave depression 835 resiliently return to their initial at rest concave state shown in FIG. 29. In other implementations, concave depressions 835 may alternatively actuate to the flattened state shown in FIG. 30 in response to the particular finger stall or the glove receiving fingers or the palm of a person's hand or in response to outward force applied to the opposite convex surface 837 by a person's fingers or hand palm. In some implementations, each movable gripping region 830 which is movable from a concave state to the flattened state may additionally be transversely movable. For example, each of the gripping panels described above with respect to movable gripping regions 30, 130, 230, 330, 430, 530 or 630 may alternatively be replaced with the concave but resiliently flattenable depression 835 such that each movable gripping region 830 not only flattens upon catching a ball, but translates or slides transversely with the football after the football is caught. Although the FGRs are shown in a particular location and configuration, it is contemplated under the present invention that the FGRs and MGRs can be arranged and positioned in other numbers, shapes, configurations, locations and/or sizes and in any combination thereof.

Figure 31:
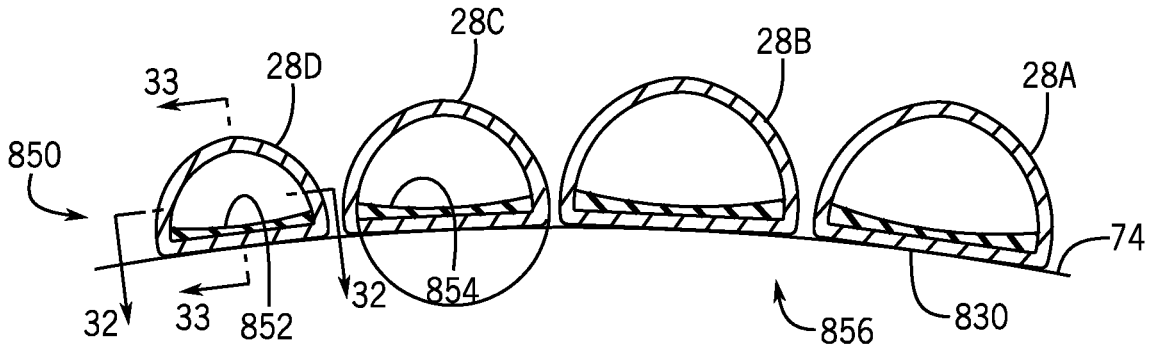
FIG. 31 is a sectional view across finger stalls of another example implementation of the glove of FIG. 1.
Figure 32:
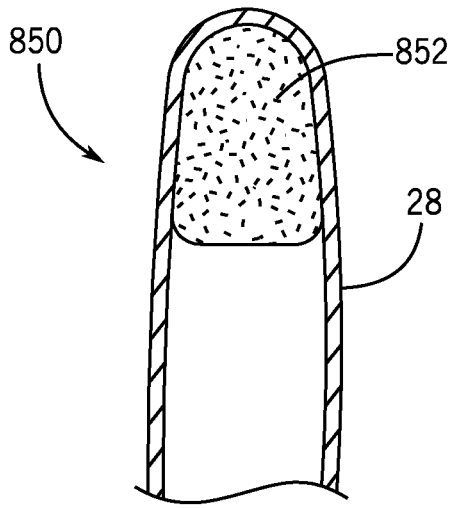
FIG. 32 is a sectional view of a finger stall of the glove of FIG. 31 take along line 32-32.

FIGS. 31 and 32 are sectional views of glove 850, an example implementation of glove 820. Glove 850 is similar glove 820 except that glove 850 comprises arcuate resting pads 852. Like glove 820, glove 850 comprises movable gripping regions 830 which resiliently flatten when encountering a receiving force or pressure from a football being caught and/or a user of the glove asserting force and/or pressure against the surface of the football or other object. FIG. 31 illustrates glove 850 catching a football with movable gripping regions 830 in the flattened state.

As shown by FIG. 31, arcuate resting pads 852 extend within the interior of each of stalls 28. Arcuate resting pads 852 provide an arcuate concave surface 854 facing away from the palm side 856 of glove 850 towards the back of the associated stall 28. Arcuate resting pads 852 provide the finger tips and/or palm side of the fingers of the user with a tactile sensation of a rounded surface. As a result, finger stall 28 is comfortable, form fitting and provides better performance. In another implementation, the resting pads 852 can have a flat profile or a generally flat shape. The inward surface (the surface contacting the finger tips of the user) of the resting pads 852 can be smooth and formed of a highly grip-able material such as a silicon, or the inward surface can be roughened, pebbled or otherwise textured. In another implementation, the resting pads can be a finger tip gripping or contact region having a plurality of projections for contacting the finger tips or fingers of the user. The fingertip gripping region can have greater grip ability than a second portion of the inner surface of the at least one finger stall. In such an implementation, the inner surface of the finger stall can be formed of one or more materials having a predetermined level of grip ability or tackiness, and the finger tip gripping region can be formed of one or materials that have a higher level of grip ability or a higher level of tackiness. Accordingly, the user feels a highly grip-able surface on his or her fingertips when grasping the football with his or her gloved hands.

In one implementation, arcuate resting pad 852 comprises an insert that is welded, bonded, stitched or otherwise secured in place within each stall 28. In one implementation, arcuate resting pad 852 is formed from a material distinct from the material forming the walls of stall 28 or movable gripping region 830. In one implementation, resting pad 852 is formed from material and has a thickness such that resting pad 852 has a greater compressibility and greater resiliency as compared to the surrounding materials of stall 28 or movable gripping region 830, providing greater shock absorption between the palm side of glove 850 and the palm side of the person's fingers.

Figure 33:
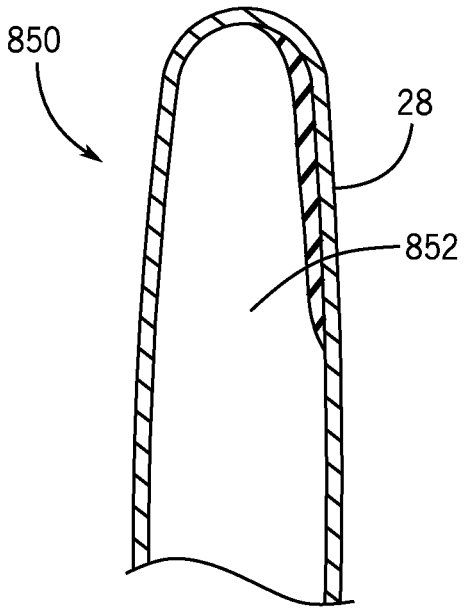
FIG. 33 is a sectional view of another implementation of the finger stall of the glove of FIG. 31 take along line 33-33.

As shown by FIG. 32, in one implementation, arcuate resting pad 852 is provided at a fingertip portion of the particular stall and has cavity or depression with the shape or outer profile of a fingertip. In such an implementation, resting pad 852 improves the feel or gripping sensation of the wearer. As shown by FIG. 33, in one implementation, resting pad 852 may alternatively comprise a continuous pad along a length of stall 28, extending across two or more phalanges of an individual finger or thumb. In one implementation, resting pad 852 may comprise multiple spaced pad sections, each spaced pad section having a length corresponding to the opposite phalange of the person's hand, wherein spacings or gaps between adjacent pads correspond to palm side knuckle joints between the phalanges to allow for flexing of the knuckles of the finger stall and finger of the user. Although illustrated as being utilized with movable gripping regions 830 which actuate between concave and flatten states, in other implementations, resting pads 852 may also be provided in the interior of stalls 28 of glove 760 or glove 770 described above.

FIGS. 34 and 35 illustrate gloves 860 being worn by a person. FIG. 34 illustrates glove 34 positions us about to catch a football 861. FIG. 35 illustrates glove 860 a palm side of each of gloves 860 in the position shown in FIG. 34. The gloves 860 illustrate another preferred arrangement of MGRs and/or FGRs for facilitating the catching of a football. In the implementation of FIGS. 34 and 35, areas of the palm are advantageously configured without MGRs and FGRs because those areas of the palm are less likely to engage the football when catching the ball. Accordingly, the implementation of FIGS. 34 and 35 is one optimal arrangement of MGRs and/or FGRs for catching a football without excessive or unnecessary MGRs and/or FGRs. In other implementations, other arrangements of MGRs and FGRs can be used.

Each of gloves 860 shown in FIGS. 34 and 35 is similar to glove 20 except that the palm side 862 of each of gloves 860 is formed from one or more translucent or transparent layers or materials such that at least portions of the palm side of the person's hand (the person's actual palm or the palm side of the person's fingers or thumb) are visible through the palm side 862 of glove 860. In one implementation, the entire palm side of glove 860 can be translucent or transparent. In another implementation, portions of the palm side 62 of glove 860 surrounding movable gripping regions or gripping panels can be translucent or transparent, while movable gripping regions or the gripping panels of such regions are opaque. In yet other implementations, the movable gripping regions or the associated gripping panels can be translucent or transparent while those portions of the palm cited 62 of glove 860 surrounding the movable gripping regions are opaque. As shown by FIG. 34, in one implementation, the backside of each of gloves 860 is formed from one or more layers of opaque fabric or material. In other implementations, both the front side and the backside of glove 860 may be formed from a translucent or transparent material.

FIG. 35 further illustrates movable gripping regions 870. Movable gripping regions 870 are provided on the palm side 862 of each of gloves 860 across regions or areas of the palm cited 62 of glove 860 so as to more likely contact football 861 during the catch illustrated in FIG. 34. In particular, movable gripping regions 870 are provided on the finger stalls 28 along each phalange of the person's hands within glove 860 and are further provided in a region 872 extending from the index finger to and at least partially across the thenar eminence (the region containing the muscles that the base of the thumb). Because movable gripping regions 870 are simply located at those regions of the palm cited 62 of glove 860 is likely to contact football 861 during a proper catching of football 861, movable gripping regions 870 are more likely to enhance the ability of a person to catch the football while, at the same time, not being so extensive so as to interfere with the wherein comfort of gloves 860. In other implementations, movable gripping regions 870 may have other extents and locations. Importantly, in the present implementation, MGRs 870 are not positioned in other locations about the palm. Rather, they are only positioned in those areas of the palm that engage the ball during a proper catch. In this manner, the gloves of the present implementation can be used to facilitate training a player regarding the appropriate orientation or positioning of his or her hands so as to engage the MGRs with the ball upon making a catch. The optimal placement of MGRs and/or FGRs allows for the weight of the glove to be optimized. Accordingly, the gloves are not unnecessarily heavy.

Each of movable gripping regions 870 comprises one or more of the above described movable gripping regions 30, 130, 230, 330, 430, 530, 630, 730 and/or FGR 830, alone or in combination. In one implementation, one or more of the movable gripping regions 870 may be configured to resiliently flatten (similar to FGR 830) or may be permanently flat (similar to movable surfaces 762 of glove 760). In one implementation, the movable gripping regions 870 which are flat or which resiliently flatten may additionally be configured to slide or transversely move relative to surrounding portions of the glove such as with movable gripping regions 30, 130, 230, 330, 430, 530, 630, 730. It should be noted that with respect to movable gripping regions 130, 230, 330, 430, 530, 630 and 730, the individual movable gripping regions may alternatively be configured to move along a transverse axis, along an axis that is perpendicular to the illustrated axis 189. In some implementations, one or more of such illustrated movable gripping regions 870 may be omitted.

Figure 36:
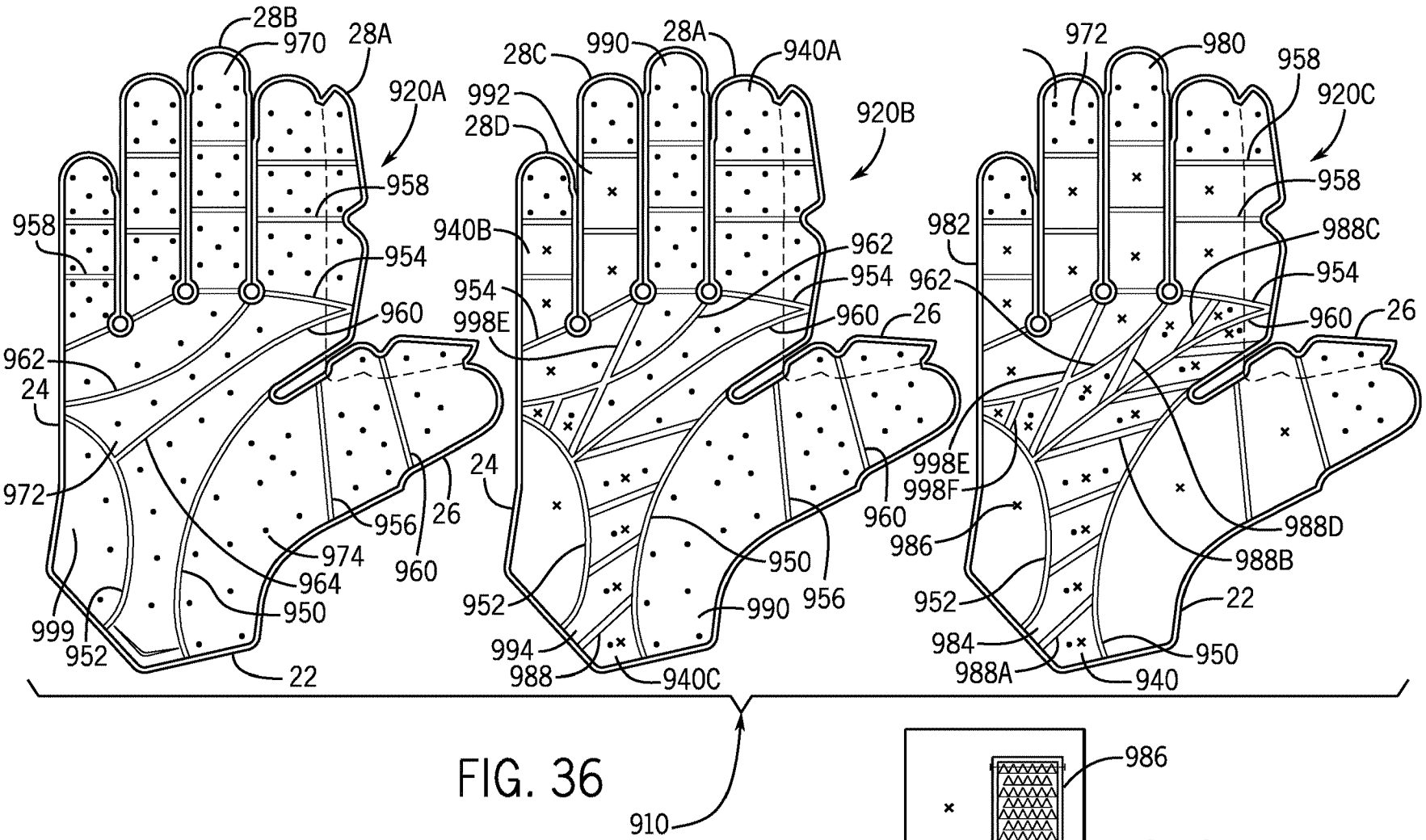
FIG. 36 is a front view of an example set of gloves.

FIG. 36 illustrates an example set 910 of three different gloves 920A, 920B and 920C (collectively referred to as gloves 920) for different performance roles in a sport, such as American football. In the example illustrated, each of gloves 920 is similar to glove 20 described above) in that each of such gloves comprises wrist portion 22, palm portion 24, thumb stall 26, and finger stalls 28A, 28B, 28C and 28D (collectively referred to as finger stalls 28), described above. Each of gloves 920 comprises a base layer of nylon or elastane (e.g., Lycra®) and a palm side outer layer of silicon, suede other material having a high coefficient of friction. Each of gloves 920 comprises palm side grooves that facilitate bending of the glove along hand bending lines. In the example illustrated, each of gloves 920A, 920B, 920C comprises thumb side palm bending line 950, pinky side palm bending line 952, finger base bending lines 954, thumb base bending line 956, mid finger bending lines 958, mid-thumb bending line 960, upper mid-palm bending line 962 and lower mid-palm bending line 964. Thumb side palm bending line 950 extends from the base of the wrist portion 22 of each of gloves 920 to the juncture of thumb stall 26 and index finger stall 28A to facilitate bending of a base of the palm adjacent and below the thumb. Pinky side palm bending line 952 extends from the base of each of glove 920 across a lower left corner (as seen in the figures) of the palm side to facilitate bending of the side of a person's palm opposite to the thumb. Finger base bending lines 954 extend between palm portion 24 and base of each of finger stalls 28. Thumb based bending line 956 extends between palm portion 24 and the base of thumb stall 26. Mid finger bending like 958 extend along each of finger stalls 28 at locations corresponding to the joints of each of the received fingers. Mid-thumb bending line 960 extends across the palm side of thumb stall 26 at a location corresponding to a middle joint of the thumb. Upper mid-palm bending line 962 and lower mid-palm bending line 964 extend across midpoint of the palm side of palm portion 24 to facilitate further bending of a person's palm. Each of the aforementioned bending lines facilitates bending and articulation of a person's hand.

Each of gloves 920A, 920B, 920C has a unique set of performance zones, each zone having a distinct surface characteristic. As shown by FIG. 36, glove 920A comprises a single continuous performance zone 970 across substantially an entire palm side of glove 920A. Performance zone 970 has a substantially smooth or flat surface across the entirety of zone 970 but for perforations 972 (represented by lightly drawn circles) and perforations 974 (represented by darkly drawn circles). Perforations 972 extend through the outermost layer, such as a layer silicone or suede, but terminate at the base layer of resiliently flexible or elastic nylon or Lycra. Perforations 974 extend through both the outermost layer providing the ball contact surface and the underlying base layer which contacts a person's hands. Because zone 970 is substantially flat and smooth and because zone 970 extends across substantially the entire palm side of glove 920A, the amount of surface area of the palm side of glove 920A that may be maintained in contact with a ball during play is larger. As a result, glove 920A and its performance zones 970 are well-suited for catching a ball. In the game of American football, glove 920A is well-suited for wide receivers or those individuals desiring an improvement in the ability to catch and retain a football (or other ball in other sports).

Glove 920C comprises a glove comprising performance zones 980, 982 and 984. Performance zone 980 is similar to performance zone 970 in that performance zones 980 are substantially flat or smooth, but for perforations 972, 974. Performance zones 980 are located on tips of the palm side of finger stalls 28 and thumb stall 26. Performance zones 980 facilitate catching a ball and inhibit unintended and accidental catching of such fingertips on another player's jersey.

Figure 37:
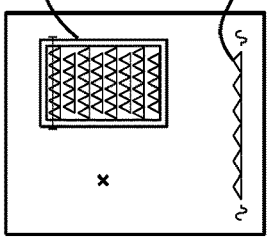
FIG. 37 is an enlarged view and a sectional view illustrating gripping projections on one of the gloves of FIG. 36.

Performance zone 982 comprise those surface regions of the palm side of glove 920C having pointed raised gripping projections 986 (represented by single X's in the respective zones 982). As shown by FIG. 37, the raised gripping projections 986 can comprise pointed protuberances that project from the surface of the glove and which are configured to assist in gripping or grasping another player or the other player's uniform. In the example illustrated, such pointed gripping projections 986 comprise semi-pyramidal structures having a wider base proximate to wrist portion 22 and an apex proximate to or pointing towards the fingertips. In other implementations, projections 986 may have other shapes, such as semi-dome shapes having a flat base and a rounded apex.

In the example illustrated, such pointed raised projections 986 are arranged such that when a person bends his or her fingers and/or thumb downward across his or her palm, such projections 986 on the finger stalls 28 or thumb stall 26 cooperate with, and interact with, such pointed raised projections 986 on the palm portion to provide enhanced gripping of a player or of the player's uniform. When knuckles of the fingers bend close the hand, projections 986 follow an arc path and close towards one another to assist in pinching, staying or catching material on the palm side, such as an opponent's jersey. In one implementation, such raised projections 986 are integrally formed as a single unitary body with the underlying outer layer of silicone.

In the example illustrated, performance zone 982 extends from the palm side of the figure stalls 28 across at least a portion of the palm portion 24. In the example illustrated, performance zones 982 cover the two lowermost joint segments of finger stalls 28, cover the portion of palm portion 24 above hand been line 962, cover the portion to the left of hand been line 952, covers the palm portion to the right of thumb side and the bending line 950 and covers the region between bending lines 956 and 960. In other implementations, zones 982 may have other extents on the palm side of glove 920C.

Performance zones 984 are similar to performance zones 982 except that performance zones 984 additionally comprise raised walls or ribs 988A, 988B, 988C, 988D, 988E and 988F (collectively referred to as ribs 988). Ribs 988 comprise outwardly projecting walls. In one implementation, ribs 988A extend between bending lines 950 and 952. Rib 988B extends between bending lines 950 and 960. Rib 988C extends from bending line 960 to finger bending line 954 at the base of index finger stall 28A. Ribs 988D extend from bending line 960 to bending line 962. Rib 988E extends from bending line 952 across the palm from bending line 962 to the intersection of the base of middle finger stall 28B and ring finger stall 28C. Rib 988F extends from bending line 952 to bending line 962. Such ribs 988 provide additional enhanced gripping. As a result, glove 920C is well-suited for those players wishing to grasp, block and/or tackle another player, such as a defensive lineman or offensive lineman in American football.

Glove 920B comprises a hybrid of gloves 920A and 920C. Glove 920B comprises performance zones 990, 992 and 994. Performance zones 990 (represented by those regions having just perforations 970, 972) are similar to performance zones 970 and 980 in the performance zones 990 are substantially flat or smooth, but for perforations 972, 974. Performance zones 990 are located on the palm side of glove 920B is at the final outermost joint or segment of pinky finger stall 28D, ring finger stall 28C, at or across the entirety of thumb stall 26, index finger stall 28A and middle finger stall 28B, on those portions of palm portion 24 to the right of hand bend line 950 and from the base of index finger stall 28A and middle finger stall 28B to pinky side palm bending line 952. Performance zones 990 are located on the aforementioned palm side surfaces of glove 920B that most frequently contact or engage a football being caught. As a result, performance zones 990 enhance the ability of a player action retain the football.

Performance zones 992 (represented by areas having just x's and possibly perforations 970, 972) are similar to performance zones 982 of glove 920C. Performance zones 992 comprise raised gripping projections 986, but omit ribs 988. Performance zones 992 enhance gripping of an opposing player. Performance zones 992 are located on the palm side of glove 920B at the two lowermost joints or segments of ring finger stall 28C and pinky finger stall 28D, from the base of ring finger stall 28C and pinky finger stall 28D to the left of rib 998E, terminating above bending line 962. Performance zones 992 further extend to the left of bending line 952.

Performance zones 994 (regions having both X's and ribs) are similar to performance zones 984 of glove 920C except that performance zones 994 cover a smaller area of the palm side of glove 920B than the performance zones 984 of glove 920C. Performance zones 994 extend between bending lines 960, 962 and between bending lines 952 and 950. Overall, the reduced area of zones 994 as compared to glove 920C enhances the ability of glove 920C to assist in catching a ball. At the same time, the additional provision of zones 992 and 994 enhance ability of glove 920 to grip opposing players. As a result, glove 920B is well-suited for those positions which demand that a player both be able to catch and retain a ball as well as grip, block and/or tackle an opposing player. Glove 920B may be well-suited for player positions such as tight end, linebacker, cornerback or safety. If a particular player wishes to enhance an acknowledged deficiency, such as catching a ball or tackling, the particular player may select one of gloves 920 to address the deficiency.

The implementation of FIG. 36 illustrates a set or system of football gloves or sports gloves for outfitting an entire team or group of players. The set of gloves enables each player to be equipped with the glove that best fits his or her needs for his or her position. It is contemplated that the gloves of the present invention can be used, sold, offered for sale, made or imported into the US as individual gloves, or as a set or system of gloves. It also contemplated that other configurations for the projections 986 can be used in other implementations, or combinations of different shaped projections. The set of gloves can be used to outfit an entire football team or a position group of a team or an individual player. Still further, other configurations of performance zones, bending lines and ribs are contemplated under the present invention. In other implementations, other shapes, sizes, numbers, configurations, and combinations of performance zones, bending lines and ribs can be used. In some implementations, bending lines and/or ribs may be omitted.

In one implementation, a fourth performance zone 999 can be incorporated into one or more of the gloves 920A, 920B and/or 920C. The fourth performance zone 999 is preferable sufficiently sized to be tested under the Standard Test Method of Performance Specifications for Newly Manufactured Football Players and Coverings, National Operating Committee on Standards for Athletic Equipment (NOCSAE) DOC (ND) 019-10m12 dated May 2012 (attached as an appendix hereto). The NOCSAE Standard Test Method requires the test sample from the glove or hand covering material to be from the palm or the finger of the glove. The hand covering of the sample must be free of seams, have a width of at least 1 inch, and have a contact area of at least 2 square inches. The performance zone 999 can be formed and sized so as to provide a sample location for the NOCSAE Standard Test Method. According to one implementation, each of the gloves 20-1020 satisfies section 9 Performance Requirements of the NOCSAE Standard Test Method. In particular, the MGRs and the FGRs satisfy performance requirements 9.1, 9.2 and 9.3 of such standards. In particular, when tested in accordance section 8.1, the hand covering material such gloves must freely fall from a pebbled glass service within 90 seconds after the glass of rotated a full 180°. When tested in accordance with Section 8.2, the surface coefficient of friction (SCOF) must be 4.5 or less. When tested in accordance with sections 8.1 and 8.2, no visible transfer material occurs between the hand covering material to the pattern #62 glass. In another implementation, the performance zone 999 can be formed of a material that is less grippable or less tacky or less tactile than the material used in the other performance zones 970, 972 and 974. The performance zone 999 can be configured to fully satisfy the Performance Requirements of the NOCSAE Standard Test Method, and one or more of the other performance zones 970, 972 and 974 can be configured with peel adhesion characteristics and/or coefficient of friction values that exceed the Performance Requirements.

Figure 38:
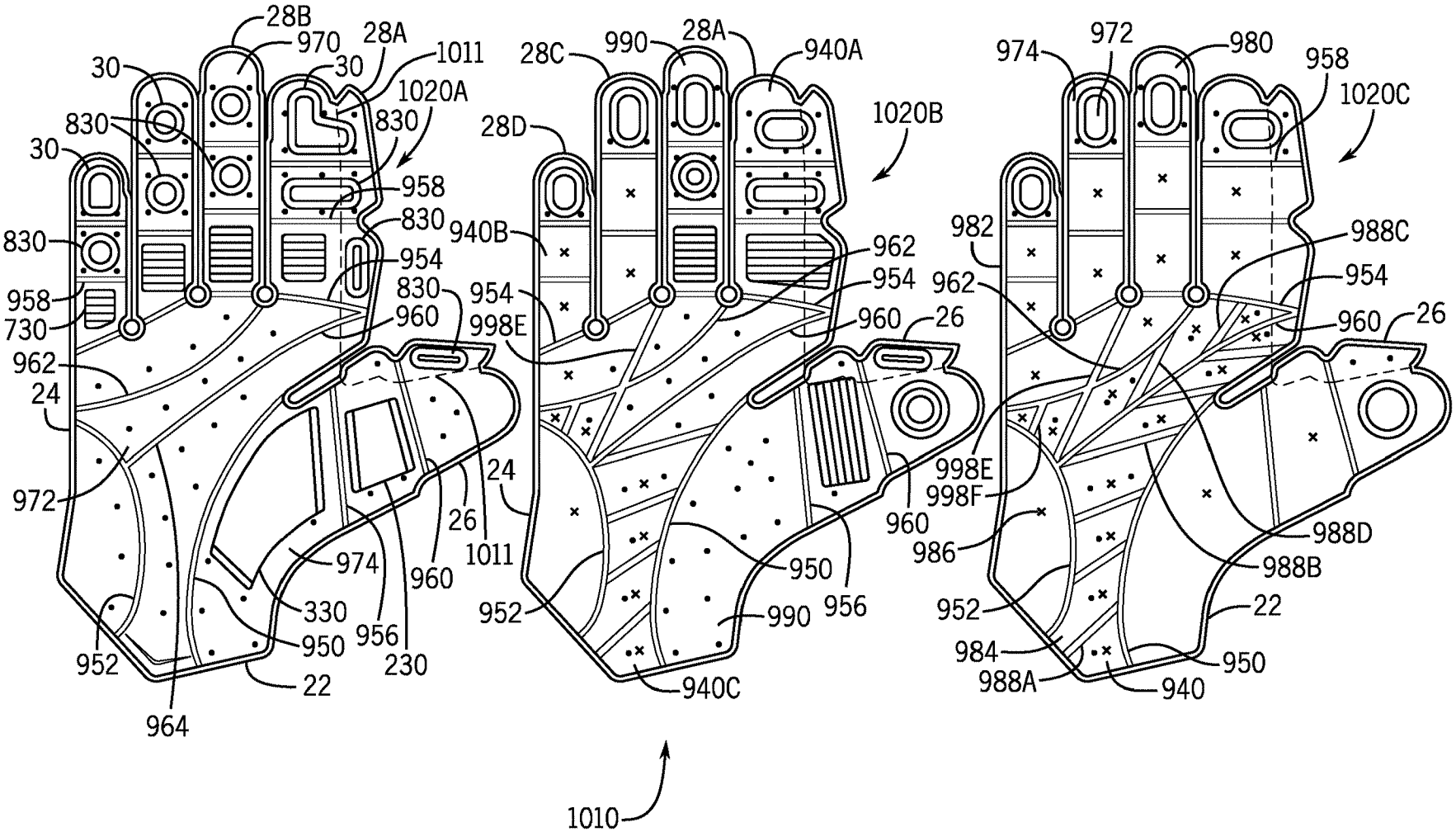
FIG. 38 is a front view of another example set of gloves.

FIG. 38 illustrates a set 1010 of gloves 1020A, 1020B and 1020C (collectively referred to as gloves 1020). Gloves 1020 are similar to gloves 920 except that performance zones 970, 980 and 990 additionally comprise one or more MGRs or FGRs. In the example illustrated, glove 1020A comprises MGRs 30, MGRs 230, MGR 330, MGRs 730 and FGRs 830, described above. Dotted lines 1011 indicate the palm side edges of thumb stall 26 and index finger stall 28A. Those side portions beyond dotted line 1011 comprise services of the home stall 26 and the index finger stall 28A that face one another in a generally contact one another when the thumb is closed against a side of the palm portion 24. Such side portions extend along the inner side of the thumb and the outer side of the index finger. In the example illustrated, thumb stall 26 further comprises and FGR 830 while the cited portion of the index finger also comprises MGR 830. As a result, enhanced gripping surfaces are also provided on the sides of the thumb and index finger for catching a ball or holding a ball.

In each of the above-described gloves 20-1020, the base layer has been described as comprising a layer of resiliently flexible elastic material such as nylon or elastane (e.g., Lycra®). In other implementations, the base layer of such gloves 20-1020 may alternatively comprise a non-fabric material. In one implementation, the base layer of such gloves 20-1020 on the palm side of the glove may comprise a transparent or translucent material such that at least portions of a person's skin on the finger or palm are visible. For example, in one implementation, the base layer of such gloves on the palm side may comprise a translucent or transparent silicone or other transparent elastic material. In one implementation, those portions of each glove that simply cover the palm portion 24 may be transparent while the base layer covering the fingers and thumb are opaque. In one implementation, portions of the base layer on the palm side of each of the gloves may be transparent while the portions are opaque. The opaque portions or the transparent portions of both hands, when positioned adjacent one another may form a logo, image, word or the like.

Although the present disclosure has been described with reference to example embodiments, workers skilled in the art will recognize that changes may be made in form and detail without departing from the spirit and scope of the claimed subject matter. For example, although different example embodiments may have been described as including one or more features providing one or more benefits, it is contemplated that the described features may be interchanged with one another or alternatively be combined with one another in the described example embodiments or in other alternative embodiments. Because the technology of the present disclosure is relatively complex, not all changes in the technology are foreseeable. The present disclosure described with reference to the example embodiments and set forth in the following claims is manifestly intended to be as broad as possible. For example, unless specifically otherwise noted, the claims reciting a single particular element also encompass a plurality of such particular elements.

What is claimed is:

1. A sports glove for covering a hand and at least a portion of a wrist of a player, the glove comprising:

a wrist portion defining an opening for receiving the hand of the player and for extending over at least a portion of the wrist of the player's wrist;

a palm portion having a palm side and a backside, the palm side of the glove comprises at least a fabric layer bordering an interior of the glove to contact the received hand of the player, and a resilient rubber-like polymer layer on an outer surface of the fabric layer extending substantially over the entire palm side of the glove, the resilient rubber-like polymer layer including at least first and second grooves for facilitating bending of the glove;

a thumb stall extending from the palm portion; and a plurality of finger stalls extending from the palm portion, the plurality of finger stalls including an index finger stall, a middle finger stall, a ring finger stall and a pinky finger stall, the first groove forming a thumb base bending line extending from at or adjacent to the opening of the wrist portion along the palm portion to a juncture of the thumb stall and the index finger stall, the second groove forming an upper mid-palm bending line extending across the palm portion adjacent at least the pinky finger stall and the ring finger stall, the first and second grooves being entirely spaced apart from each other.

2. The glove of claim 1, wherein the fabric layer comprises one of elastane and nylon.

3. The glove of claim 1, wherein the resilient rubber-like polymer layer comprises silicone.

4. The glove of claim 1, wherein the resilient rubber-like polymer layer includes a plurality of spaced apart perforations extending entirely through the polymer layer.

5. The glove of claim 1, wherein the at least first and second grooves further includes a third groove, wherein the third groove forms a pinky side bending line extending from at or near the opening of the wrist portion along the palm side of the palm portion to a pinky stall side of the palm side, and wherein the third groove is entirely spaced apart from the first and second grooves.

6. The glove of claim 1, wherein the at least first and second grooves further includes a third groove, wherein the third groove forms a finger base bending line extending along the palm side of the palm portion at the base of the finger stalls, and wherein the third groove is entirely spaced apart from the first and second grooves.

7. The glove of claim 1, wherein the at least first and second grooves further includes a third groove, wherein the third groove forms a lower mid-palm bending line extending along the palm side of the palm portion between the first and second grooves, and wherein the third groove is entirely spaced apart from the first and second grooves.

8. The glove of claim 1, wherein the palm portion includes a plurality of different performance zones on the palm side of the glove, and wherein the plurality of different performance zones comprises a first performance zone having a first surface characteristic extending over a first set of the finger stalls and over at least a portion of the palm side, and a second performance zone having a second surface characteristic that is different than the first surface characteristic and extends over at least a portion of a second set of the finger stalls and over at least a portion of the palm side.

9. The glove of claim 8, wherein the first surface characteristic has a first grip ability and wherein the second surface characteristic has a second grip ability that is less than the first grip ability.

10. The glove of claim 8, wherein the second surface characteristic comprises an array of raised gripping projections.

11. The glove of claim 1, wherein the resilient rubber-like polymer layer comprises at least one raised elongate rib.

12. A sports glove for covering a hand and at least a portion of a wrist of a player, the glove comprising:

a wrist portion defining an opening for receiving the hand of the player and for extending over at least a portion of the wrist of the player's wrist;

a palm portion having a palm side and a backside, the palm side of the glove comprises one or more layers of material including a fabric layer bordering an interior of the glove to contact the received hand of the player, and a resilient rubber-like polymer layer on an outer surface of the fabric layer extending substantially over the entire palm side of the glove, the resilient rubber-like polymer layer including at least first and second grooves for facilitating bending of the glove;

a thumb stall extending from the palm portion; and a plurality of finger stalls extending from the palm portion, the plurality of finger stalls including an index finger stall, a middle finger stall, a ring finger stall and a pinky finger stall, the first groove forming a thumb base bending line extending from at or adjacent to the opening of the wrist portion along the palm portion to a juncture of the thumb stall and the index finger stall, the second groove forming a pinky side bending line extending from at or near the opening of the wrist portion along the palm side of the palm portion to a pinky stall side of the palm side, the first and second grooves being entirely spaced apart from each other.

13. The glove of claim 12, wherein the fabric layer comprises one of elastane and nylon.

14. The glove of claim 12, wherein the resilient rubber-like polymer layer comprises silicone.

15. The glove of claim 12, wherein the at least first and second grooves further includes a third groove, wherein the third groove forms an upper mid-palm bending line extending across the palm portion adjacent at least the pinky finger stall and the ring finger stall, and wherein the third groove is entirely spaced apart from the first and second grooves.

16. The glove of claim 12, wherein the at least first and second grooves further includes a third groove, wherein the third groove forms a finger base bending line extending along the palm side of the palm portion at the base of the finger stalls, and wherein the third groove is entirely spaced apart from the first and second grooves.

17. The glove of claim 12, wherein the at least first and second grooves further includes a third groove, wherein the third groove forms a lower mid-palm bending line extending along the palm side of the palm portion between the first and second grooves, and wherein the third groove is entirely spaced apart from the first and second grooves.

18. The glove of claim 12, wherein the palm portion includes a plurality of different performance zones on the palm side of the glove, and wherein the plurality of different performance zones comprises a first performance zone having a first surface characteristic extending over at least a portion of a first set of the finger stalls and over at least a portion of the palm side, and a second performance zone having a second surface characteristic different than the first surface characteristic and extending over at least a portion of a second set of the finger stalls and over at least a portion of the palm side.

19. The glove of claim 18, wherein the first surface characteristic has a first grip ability and wherein the second surface characteristic has a second grip ability less than the first grip ability.

20. The glove of claim 12, wherein the resilient rubber-like polymer layer includes a plurality of spaced apart perforations extending entirely through the polymer layer.

* * * * *